US011368802B2

(12) United States Patent
Meskens

(10) Patent No.: US 11,368,802 B2
(45) Date of Patent: Jun. 21, 2022

(54) IMPLANTABLE VIBRATORY DEVICE USING LIMITED COMPONENTS

(71) Applicant: Cochlear Limited, Macquarie University (AU)

(72) Inventor: Werner Meskens, Mechelen (BE)

(73) Assignee: Cochlear Limited, Macquarie University (AU)

( * ) Notice: Subject to any disclaimer, the term of this patent is extended or adjusted under 35 U.S.C. 154(b) by 1367 days.

(21) Appl. No.: 15/162,691

(22) Filed: May 24, 2016

(65) Prior Publication Data

US 2017/0318399 A1 Nov. 2, 2017

Related U.S. Application Data

(60) Provisional application No. 62/328,233, filed on Apr. 27, 2016.

(51) Int. Cl.

| | |
|---|---|
| ***H04R 25/00*** | (2006.01) |
| ***H04R 17/10*** | (2006.01) |
| ***H04R 17/00*** | (2006.01) |

(52) U.S. Cl.

CPC ..... *H04R 25/554* (2013.01); *H04R 17/10* (2013.01); *H04R 25/606* (2013.01); *H04R 17/00* (2013.01)

(58) Field of Classification Search

CPC ..... H04R 17/10; H04R 25/60–609

USPC ..... 600/25

See application file for complete search history.

(56) References Cited

U.S. PATENT DOCUMENTS

| | | | | |
|---|---|---|---|---|
| 5,498,226 A * | 3/1996 | Lenkauskas | H04R 25/606 600/25 |
| 5,615,229 A * | 3/1997 | Sharma | H04B 5/0006 375/259 |
| 5,733,313 A | 3/1998 | Barreras, Sr. et al. | |
| 5,800,336 A * | 9/1998 | Ball | H04R 25/606 600/25 |
| 6,154,677 A * | 11/2000 | Leysieffer | H04R 25/554 607/61 |

(Continued)

FOREIGN PATENT DOCUMENTS

| | | |
|---|---|---|
| CN | 1721014 A | 1/2006 |
| CN | 102458323 A | 5/2012 |

(Continued)

OTHER PUBLICATIONS

Author Unknown, "How to run an ultrasonic piezo transducer," https://www.reddit.com/r/AskElectronics/comments/1ddruo/how_to_run_an_ultrasonic_piezo_transducer/, posted Apr. 30, 2013, downloaded May 23, 2016.

(Continued)

*Primary Examiner* — Catherine B Kuhlman

(74) *Attorney, Agent, or Firm* — Pilloff Passino & Cosenza LLP; Martin J. Cosenza

(57) ABSTRACT

A prosthesis including an implantable component including an LC circuit, wherein a piezoelectric material forms at least a part of the capacitance portion of the LC circuit, the piezoelectric material expands and/or contracts upon the application of a variable magnetic field to the inductor of the LC circuit, the LC circuit has an electrical self-resonance frequency below 20 kHz, and the piezoelectric material forms part of an actuator configured to output a force to tissue of a recipient in which the implantable component is implanted.

39 Claims, 18 Drawing Sheets

(56) References Cited

U.S. PATENT DOCUMENTS

| | | | | |
|---|---|---|---|---|
| 7,599,743 | B2 * | 10/2009 | Hassler, Jr. | A61N 1/3787 607/40 |
| 8,923,968 | B2 | 12/2014 | Meskens | |
| 2001/0051819 | A1 * | 12/2001 | Fischell | A61N 1/3605 607/45 |
| 2004/0032962 | A1 * | 2/2004 | Westerkull | H04R 25/606 381/151 |
| 2004/0093040 | A1 * | 5/2004 | Boylston | A61N 1/36036 607/57 |
| 2006/0142822 | A1 * | 6/2006 | Tulgar | A61N 1/08 607/61 |
| 2006/0290459 | A1 * | 12/2006 | Nord | H01F 27/2828 336/222 |
| 2008/0130867 | A1 * | 6/2008 | Bowen | H04M 1/03 379/443 |
| 2009/0029646 | A1 * | 1/2009 | Kristiansen | H04R 25/554 455/41.2 |
| 2010/0298626 | A1 * | 11/2010 | Andersson | H04R 25/606 600/25 |
| 2011/0022120 | A1 | 1/2011 | Ball et al. | |
| 2011/0046730 | A1 | 2/2011 | Meskens | |
| 2011/0305356 | A1 | 12/2011 | Kwan et al. | |
| 2012/0088957 | A1 | 4/2012 | Adamson et al. | |
| 2012/0296155 | A1 * | 11/2012 | Ball | A61N 1/3718 600/25 |
| 2012/0308061 | A1 | 12/2012 | Zhu et al. | |
| 2013/0029624 | A1 * | 1/2013 | Bendsen | H03G 3/3052 455/234.1 |
| 2013/0101149 | A1 * | 4/2013 | Maenpaa | H04B 5/0006 381/331 |
| 2013/0197298 | A1 * | 8/2013 | Miller | H04R 25/00 600/25 |
| 2014/0163308 | A1 | 6/2014 | Miller et al. | |
| 2014/0275728 | A1 * | 9/2014 | Koskowich | H04R 25/554 600/25 |
| 2015/0023540 | A1 | 1/2015 | Fay et al. | |

FOREIGN PATENT DOCUMENTS

| | | | | |
|---|---|---|---|---|
| CN | 102573987 | A | 7/2012 | |
| EP | 0472971 | A2 | 3/1992 | |
| EP | 1609503 | A1 | 12/2005 | |
| EP | 2094029 | A2 * | 8/2009 | H04R 25/606 |
| KR | 101109110 | B1 | 2/2012 | |

OTHER PUBLICATIONS

Morgan Advanced Materials, "Circuit Considerations—Resonant Devices," http://www.morgantechnicalceramics.com/products/product-groups/piezo-ceramic-components/piezo-ceramic-tutorials/resonant-devices, publication date unknown, but is believed to have been published prior to the effective filing date of this application, downloaded May 23, 2016.

H. Taghavi et al, "A Novel Bone Conduction Implant—Analog Radio Frequency Data and Power Link Design," Proceeding of the IASTED International Conference on Biomedical Engineering, Feb. 2012, pp. 327-335, Chalmers.

International Search Report and Written Opinion for PCT/IB2017/052423, dated Jul. 21, 2017.

Hamidreza Taghavi et al., "A Novel Bone Conduction Implant—Analog Radio Frequency Data and Power Link Design," Conference: IASTED international conference on Biomedical Engineering, Feb. 2012.

Mahmoud Al Ahmad et al., "Modeling of MEMS piezoelectric energy harvesters using electromagnetic and power system theories," Smart Mater Struct., Jun. 28, 2011, vol. 20., IOP Publishing Ltd.

Extended European Search Report for European Patent Application No. 17 788 920.1.

Office Action in China Application No. 201780025430.0, dated Apr. 8, 2020.

* cited by examiner

IMPLANTABLE VIBRATORY DEVICE USING LIMITED COMPONENTS

CROSS-REFERENCE TO RELATED APPLICATIONS

This application claims priority to Provisional U.S. Patent Application No. 62/328,233, entitled IMPLANTABLE VIBRATORY DEVICE USING LIMITED COMPONENTS, filed on Apr. 27, 2016, naming Werner MESKENS of Mechelen, Belgium as an inventor, the entire contents of that application being incorporated herein by reference in its entirety.

BACKGROUND

Hearing loss, which may be due to many different causes, is generally of two types: conductive and sensorineural. Sensorineural hearing loss is due to the absence or destruction of the hair cells in the cochlea that transduce sound signals into nerve impulses. Various hearing prostheses are commercially available to provide individuals suffering from sensorineural hearing loss with the ability to perceive sound. For example, cochlear implants use an electrode array implanted in the cochlea of a recipient to bypass the mechanisms of the ear. More specifically, an electrical stimulus is provided via the electrode array to the auditory nerve, thereby causing a hearing percept.

Conductive hearing loss occurs when the normal mechanical pathways that provide sound to hair cells in the cochlea are impeded, for example, by damage to the ossicular chain or the ear canal. Individuals suffering from conductive hearing loss may retain some form of residual hearing because the hair cells in the cochlea may remain undamaged.

Individuals suffering from conductive hearing loss typically receive an acoustic hearing aid. Hearing aids rely on principles of air conduction to transmit acoustic signals to the cochlea. In particular, a hearing aid typically uses an arrangement positioned in the recipient's ear canal or on the outer ear to amplify a sound received by the outer ear of the recipient. This amplified sound reaches the cochlea, causing motion of the perilymph and stimulation of the auditory nerve.

In contrast to hearing aids, which rely primarily on the principles of air conduction, certain types of hearing prostheses, commonly referred to as bone conduction devices, convert a received sound into vibrations. The vibrations are transferred through the skull to the cochlea, causing generation of nerve impulses, which results in the perception of the received sound. Bone conduction devices are suitable to treat a variety of types of hearing loss and may be suitable for individuals who cannot derive sufficient benefit from acoustic hearing aids.

SUMMARY

In accordance with one embodiment, there is a prosthesis, comprising an implantable component including an LC circuit, wherein a piezoelectric material forms at least a part of the capacitance portion of the LC circuit, the piezoelectric material expands and/or contracts upon the application of a variable magnetic field to an inductor of the LC circuit, and the piezoelectric material forms part of an actuator configured to impart energy into tissue of a recipient in which the implantable component is implanted.

In accordance with another embodiment, there is an auditory prosthesis, comprising an external assembly, including a first inductance coil, and an active electronic device in signal communication with the first inductance coil, and an implantable component made up of passive electronic components including a transducer configured to output mechanical energy when an electrical current is applied thereto, and a second inductance coil that is part of a first LC resonant circuit tuned to a frequency in the audio spectrum, wherein the first and second inductance coils form a transcutaneous coupled link.

In accordance with another exemplary embodiment, there is a hearing prosthesis, including an implantable passive resonant component including a vibratory electrical capacitive apparatus and an inductance coil, wherein the vibratory apparatus and the inductance coil are encased in a titanium housing, and the implantable component is configured such that a transcutaneous signal received by the inductance coil through the titanium housing activates the vibratory apparatus to evoke a hearing percept.

BRIEF DESCRIPTION OF THE DRAWINGS

Some embodiments are described below with reference to the attached drawings, in which.

DETAILED DESCRIPTION

Figure 1:
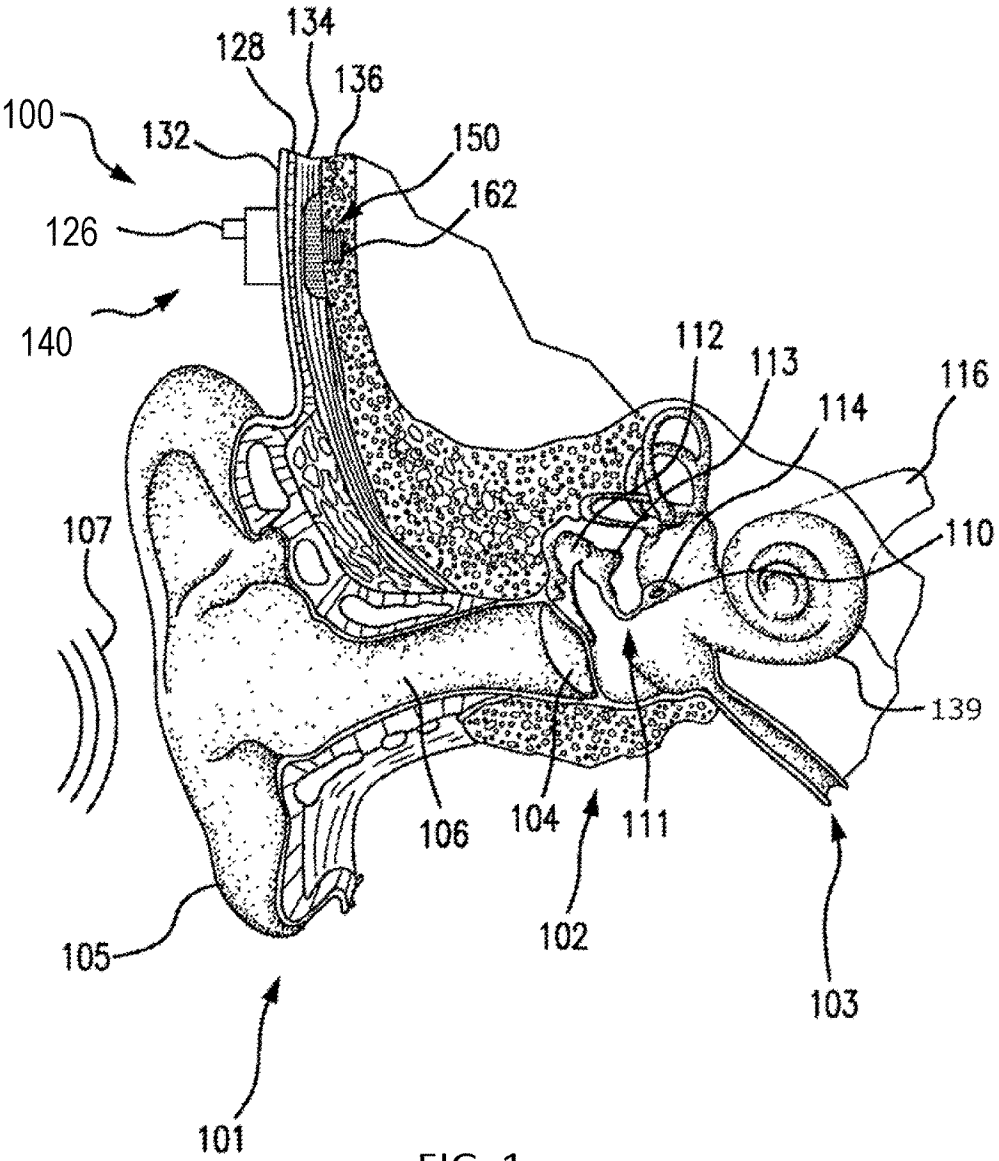
FIG. 1 is a perspective view of an exemplary bone conduction device in which at least some embodiments can be implemented.

FIG. 1 is a perspective view of a bone conduction device 100 in which embodiments may be implemented. As shown, the recipient has an outer ear 101, a middle ear 102 and an inner ear 103. Elements of outer ear 101, middle ear 102 and inner ear 103 are described below, followed by a description of bone conduction device 100.

In a fully functional human hearing anatomy, outer ear 101 comprises an auricle 105 and an ear canal 106. A sound wave or acoustic pressure 107 is collected by auricle 105 and channeled into and through ear canal 106. Disposed across the distal end of ear canal 106 is a tympanic membrane 104 which vibrates in response to acoustic wave 107. This vibration is coupled to oval window or fenestra ovalis 210 through three bones of middle ear 102, collectively referred to as the ossicles 111 and comprising the malleus 112, the incus 113 and the stapes 114. The ossicles 111 of middle ear 102 serve to filter and amplify acoustic wave 107, causing oval window 210 to vibrate. Such vibration sets up waves of fluid motion within cochlea 139. Such fluid motion, in turn, activates hair cells (not shown) that line the inside of cochlea 139. Activation of the hair cells causes appropriate nerve impulses to be transferred through the spiral ganglion cells and auditory nerve 116 to the brain (not shown), where they are perceived as sound.

FIG. 1 also illustrates the positioning of bone conduction device 100 relative to outer ear 101, middle ear 102 and inner ear 103 of a recipient of device 100. Bone conduction device 100 comprises an external component 140 and implantable component 150. As shown, bone conduction device 100 is positioned behind outer ear 101 of the recipient and comprises a sound input element 126 to receive sound signals. Sound input element 126 may comprise, for example, a microphone. In an exemplary embodiment, sound input element 126 may be located, for example, on or in bone conduction device 100, or on a cable extending from bone conduction device 100.

More particularly, sound input device 126 (e.g., a microphone) converts received sound signals into electrical signals. These electrical signals are processed by the sound processor. The sound processor generates control signals which cause the actuator to vibrate. In other words, the actuator converts the electrical signals into mechanical motion to impart vibrations to the recipient's skull.

Alternatively, sound input element 126 may be subcutaneously implanted in the recipient, or positioned in the recipient's ear. Sound input element 126 may also be a component that receives an electronic signal indicative of sound, such as, for example, from an external audio device. For example, sound input element 126 may receive a sound signal in the form of an electrical signal from an MP3 player electronically connected to sound input element 126.

Bone conduction device 100 comprises a sound processor (not shown), an actuator (also not shown), and/or various other operational components. In operation, the sound processor converts received sounds into electrical signals. These electrical signals are utilized by the sound processor to generate control signals that cause the actuator to vibrate. In other words, the actuator converts the electrical signals into mechanical vibrations for delivery to the recipient's skull.

In accordance with some embodiments, a fixation system 162 may be used to secure implantable component 150 to skull 136. As described below, fixation system 162 may be a bone screw fixed to skull 136, and also attached to implantable component 150.

In one arrangement of FIG. 1, bone conduction device 100 can be a passive transcutaneous bone conduction device. That is, no active components, such as the actuator, are implanted beneath the recipient's skin 132. In such an arrangement, the actuator is located in external component 140, and implantable component 150 includes a magnetic plate, as will be discussed in greater detail below. The magnetic plate of the implantable component 150 vibrates in response to vibration transmitted through the skin, mechanically and/or via a magnetic field, that is generated by an external magnetic plate.

In another arrangement of FIG. 1, bone conduction device 100 can be an active transcutaneous bone conduction device where at least one active component, such as the actuator, is implanted beneath the recipient's skin 132 and is thus part of the implantable component 150. As described below, in such an arrangement, external component 140 may comprise a sound processor and transmitter, while implantable component 150 may comprise a signal receiver and/or various other electronic circuits/devices.

Figure 2:
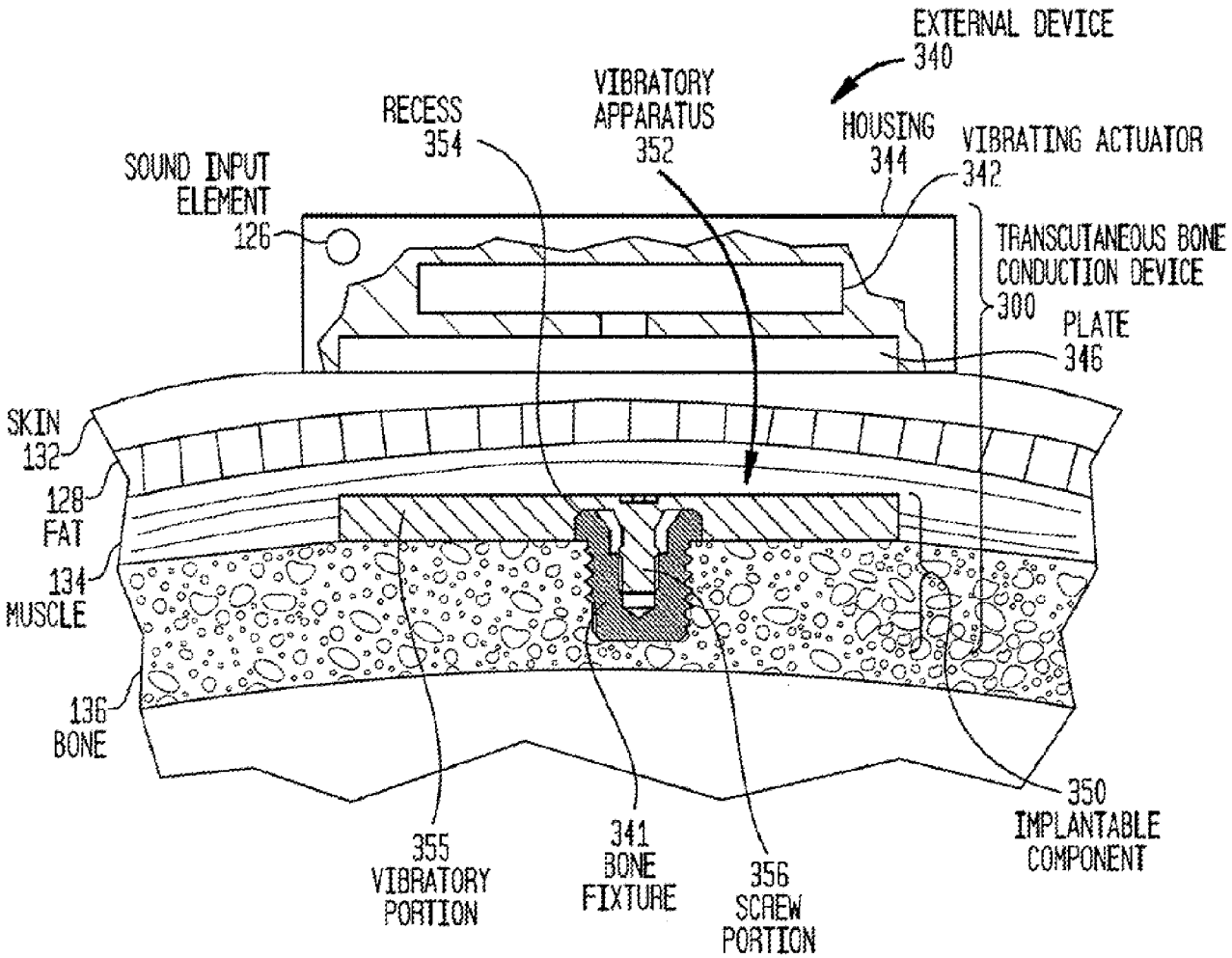
FIG. 2 is a schematic diagram conceptually illustrating a passive transcutaneous bone conduction device.

FIG. 2 depicts an exemplary transcutaneous bone conduction device 300 that includes an external device 340 (corresponding to, for example, element 140 of FIG. 1) and an implantable component 350 (corresponding to, for example, element 150 of FIG. 1). The transcutaneous bone conduction device 300 of FIG. 2 is a passive transcutaneous bone conduction device in that a vibrating electromagnetic actuator 342 is located in the external device 340. Vibrating electromagnetic actuator 342 is located in housing 344 of the external component, and is coupled to plate 346. Plate 346 may be in the form of a permanent magnet and/or in another form that generates and/or is reactive to a magnetic field, or otherwise permits the establishment of magnetic attraction between the external device 340 and the implantable component 350 sufficient to hold the external device 340 against the skin of the recipient.

In an exemplary embodiment, the vibrating electromagnetic actuator 342 is a device that converts electrical signals into vibration. In operation, sound input element 126 converts sound into electrical signals. Specifically, the transcutaneous bone conduction device 300 provides these electrical signals to vibrating electromagnetic actuator 342, or to a sound processor (not shown) that processes the electrical signals, and then provides those processed signals to vibrating electromagnetic actuator 342. The vibrating electromagnetic actuator 342 converts the electrical signals (processed or unprocessed) into vibrations. Because vibrating electromagnetic actuator 342 is mechanically coupled to plate 346, the vibrations are transferred from the vibrating electromagnetic actuator 342 to plate 346. Implanted plate assembly 352 is part of the implantable component 350, and is made of a ferromagnetic material that may be in the form of a permanent magnet, that generates and/or is reactive to a magnetic field, or otherwise permits the establishment of a magnetic attraction between the external device 340 and the implantable component 350 sufficient to hold the external device 340 against the skin of the recipient. Accordingly, vibrations produced by the vibrating electromagnetic actuator 342 of the external device 340 are transferred from plate 346 across the skin to plate 355 of plate assembly 352. This can be accomplished as a result of mechanical conduction of the vibrations through the skin, resulting from the external device 340 being in direct contact with the skin and/or from the magnetic field between the two plates. These vibrations are transferred without penetrating the skin with a solid object, such as an abutment, with respect to a percutaneous bone conduction device.

As may be seen, the implanted plate assembly 352 is substantially rigidly attached to a bone fixture 341 in this embodiment. Plate screw 356 is used to secure plate assembly 352 to bone fixture 341. The portions of plate screw 356 that interface with the bone fixture 341 substantially correspond to an abutment screw discussed in some additional detail below, thus permitting plate screw 356 to readily fit into an existing bone fixture used in a percutaneous bone conduction device. In an exemplary embodiment, plate screw 356 is configured so that the same tools and procedures that are used to install and/or remove an abutment screw (described below) from bone fixture 341 can be used to install and/or remove plate screw 356 from the bone fixture 341 (and thus the plate assembly 352).

Figure 3A:
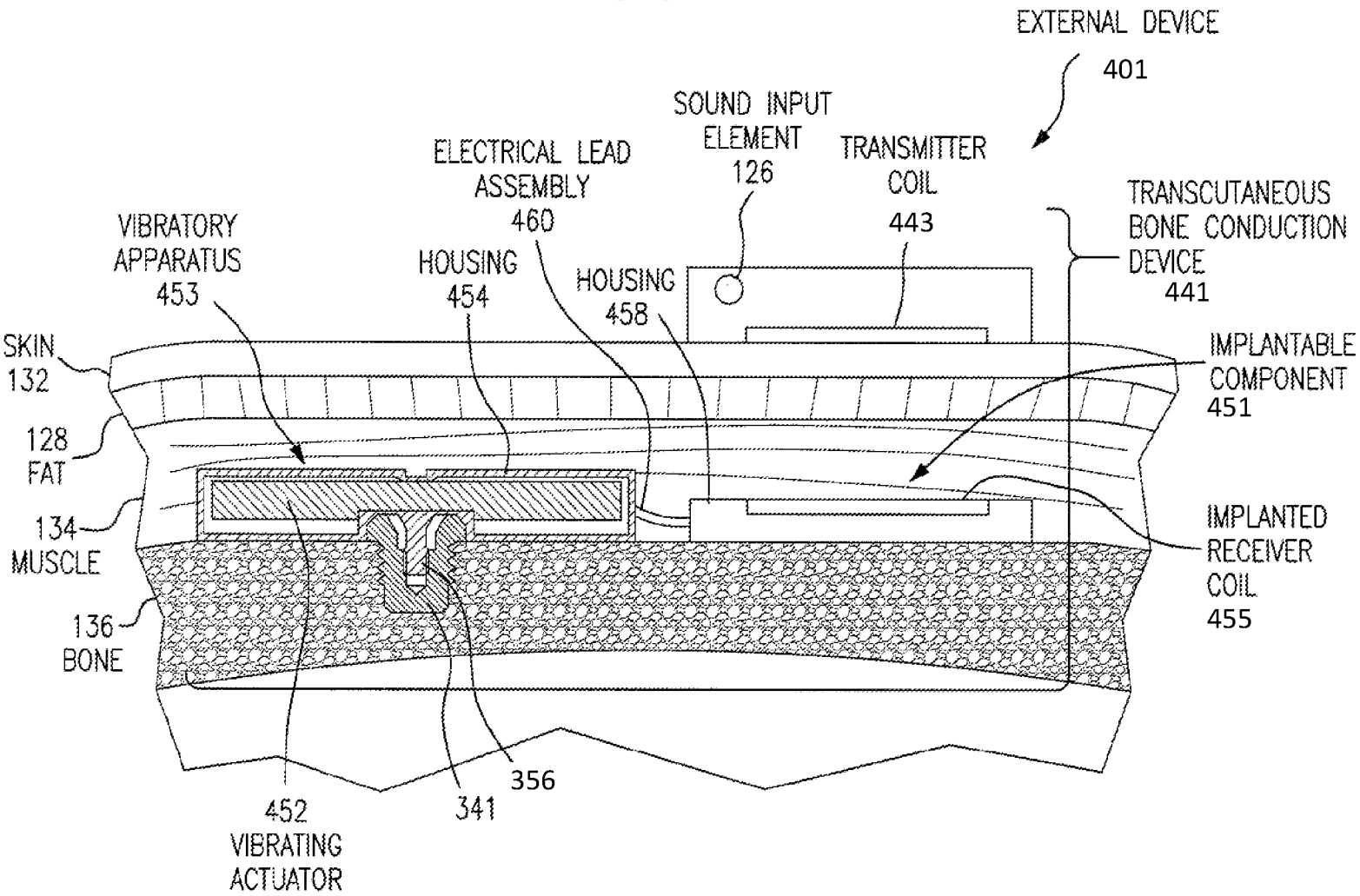
FIG. 3A is a schematic diagram conceptually illustrating an active transcutaneous bone conduction device in accordance with at least some exemplary embodiments.

FIG. 3A depicts an embodiment of a transcutaneous bone conduction device 401 according to another embodiment that includes an external device 441 (corresponding to, for example, element 140 of FIG. 1) and an implantable component 451 (corresponding to, for example, element 150 of FIG. 1). The transcutaneous bone conduction device 401 of FIG. 3A is an active transcutaneous bone conduction device in that the vibrating electromagnetic actuator 452 is located in the implantable component 451. Specifically, a vibratory element in the form of vibrating electromagnetic actuator 452 is located in housing 454 of the implantable component 451. In this embodiment, much like the vibrating electromagnetic actuator 342 described above with respect to transcutaneous bone conduction device 300, the vibrating electromagnetic actuator 452 is a device that converts electrical signals into vibration.

External component 441 includes a sound input element 126 that converts sound into electrical signals. Specifically, the transcutaneous bone conduction device 401 provides these electrical signals to vibrating electromagnetic actuator 452, or to a sound processor (not shown) that processes the electrical signals, and then provides those processed signals to the implantable component 451 through the skin of the recipient via a magnetic inductance link. In this regard, a transmitter coil 443 of the external component 441 transmits these signals to the implanted RF receiver coil 455 located in housing 458 of the implantable component 450. Components (not shown) in the housing 458, such as, for example, an RF receiver with an implanted sound processor, then generate electrical signals to be delivered to vibrating electromagnetic actuator 452 via electrical lead assembly 460. The vibrating electromagnetic actuator 452 converts the electrical signals into vibrations. In the embodiment of FIG. 3A, the transmitter and receiver thereof operates at frequencies above the auditory spectrum (i.e. RF—radio frequencies).

In an exemplary embodiment, the implantable component 451 contains an RF signal receiver with a diode envelope detector and/or various other electronic active circuits. In an exemplary embodiment, the vibrating electromagnetic actuator 452 is connected to the electronic circuit of the implantable component 451.

The vibrating electromagnetic actuator 452 is mechanically coupled to the housing 454. Housing 454 and vibrating electromagnetic actuator 452 collectively form a vibratory apparatus 453. The housing 454 is substantially rigidly attached to bone fixture 341.

Figure 3B:
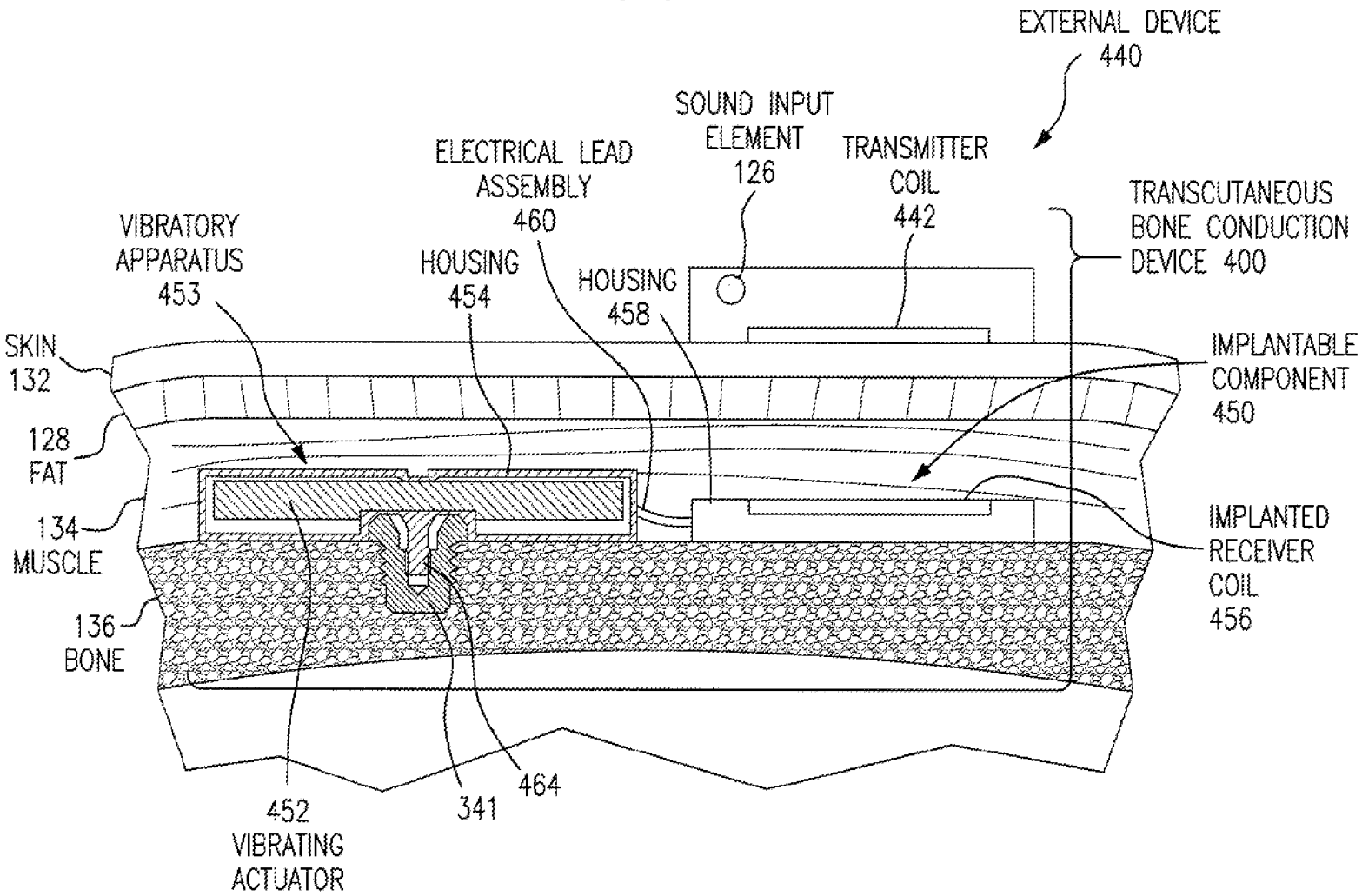
FIG. 3B is a schematic diagram conceptually illustrating another active transcutaneous bone conduction device in accordance with at least some exemplary embodiments.

FIG. 3B depicts an alternate embodiment of a transcutaneous bone conduction device 400 according to another embodiment that includes an external device 440 (corresponding to, for example, element 140 of FIG. 1) and an implantable component 450 (corresponding to, for example, element 150 of FIG. 1). The transcutaneous bone conduction device 400 of FIG. 3B is also an active transcutaneous bone conduction device in that, as with the embodiment of FIG. 3A, the vibrating electromagnetic actuator 452 is located in the implantable component (implantable component 450). Specifically, a vibratory element in the form of vibrating electromagnetic actuator 452 is located in housing 454 of the implantable component 450 and connected to an electronic circuit that is part of the implantable component 450.

External component 440 also includes a sound input element 126 that converts sound into electrical signals. Specifically, the transcutaneous bone conduction device 400 provides these electrical signals to vibrating electromagnetic actuator 452, or to a sound processor (not shown) that processes the electrical signals, and then provides those processed signals to the implantable component 450 through the skin of the recipient via a magnetic inductance link. In this regard, a transmitter coil 442 of the external component 440 transmits these signals to the implanted inductance current receiver coil 456 located in housing 458 of the implantable component 450. In this embodiment, the coils 442 and 456 are not RF coils, or, more accurately, the link established by these coils is not an RF link, but a link having a frequency of less than 20 kHz established by magnetic inductance.

Figure 4:
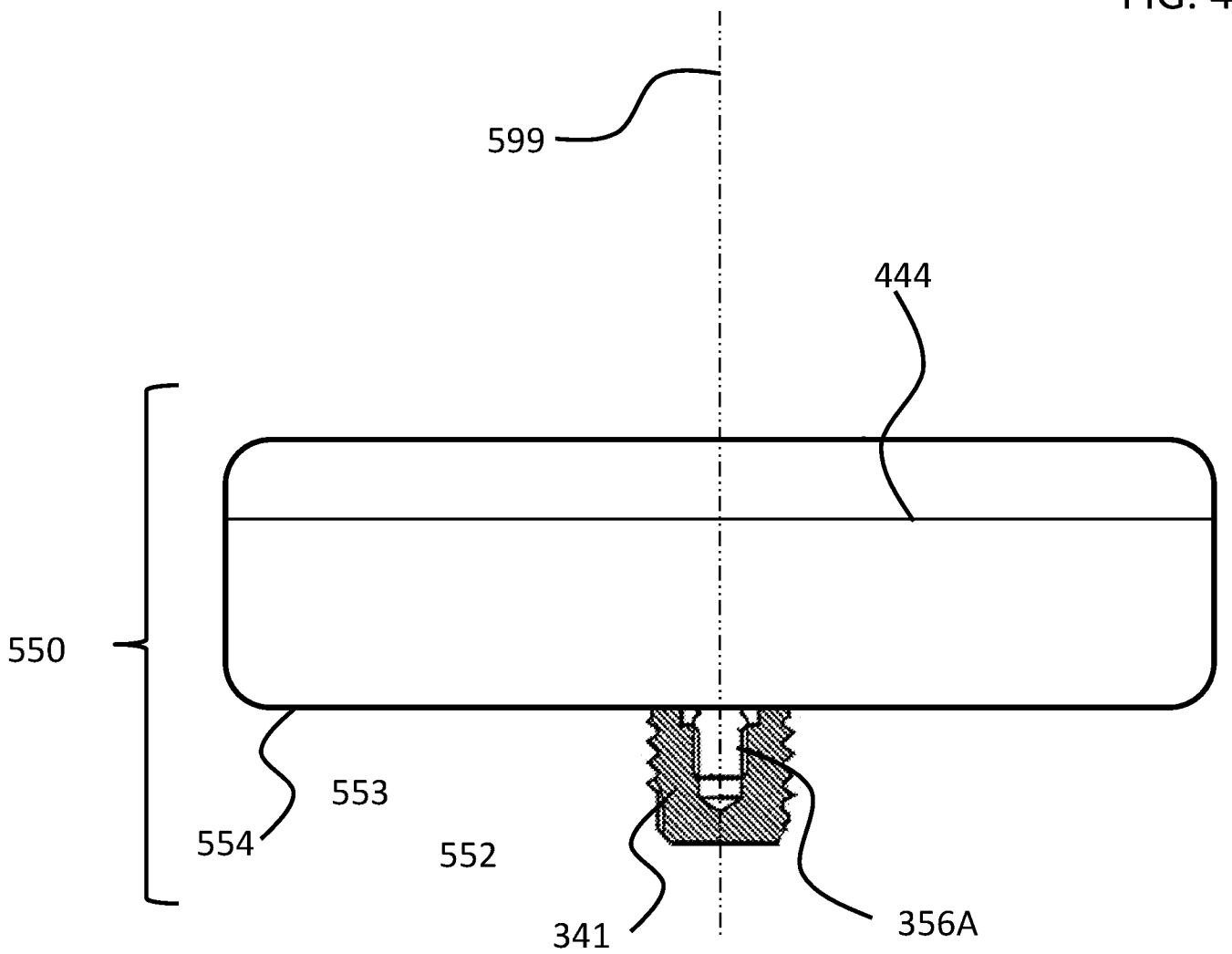
FIGS. 4 and 5 are schematics of an exemplary implantable component in accordance with at least some embodiments.
Figure 5:
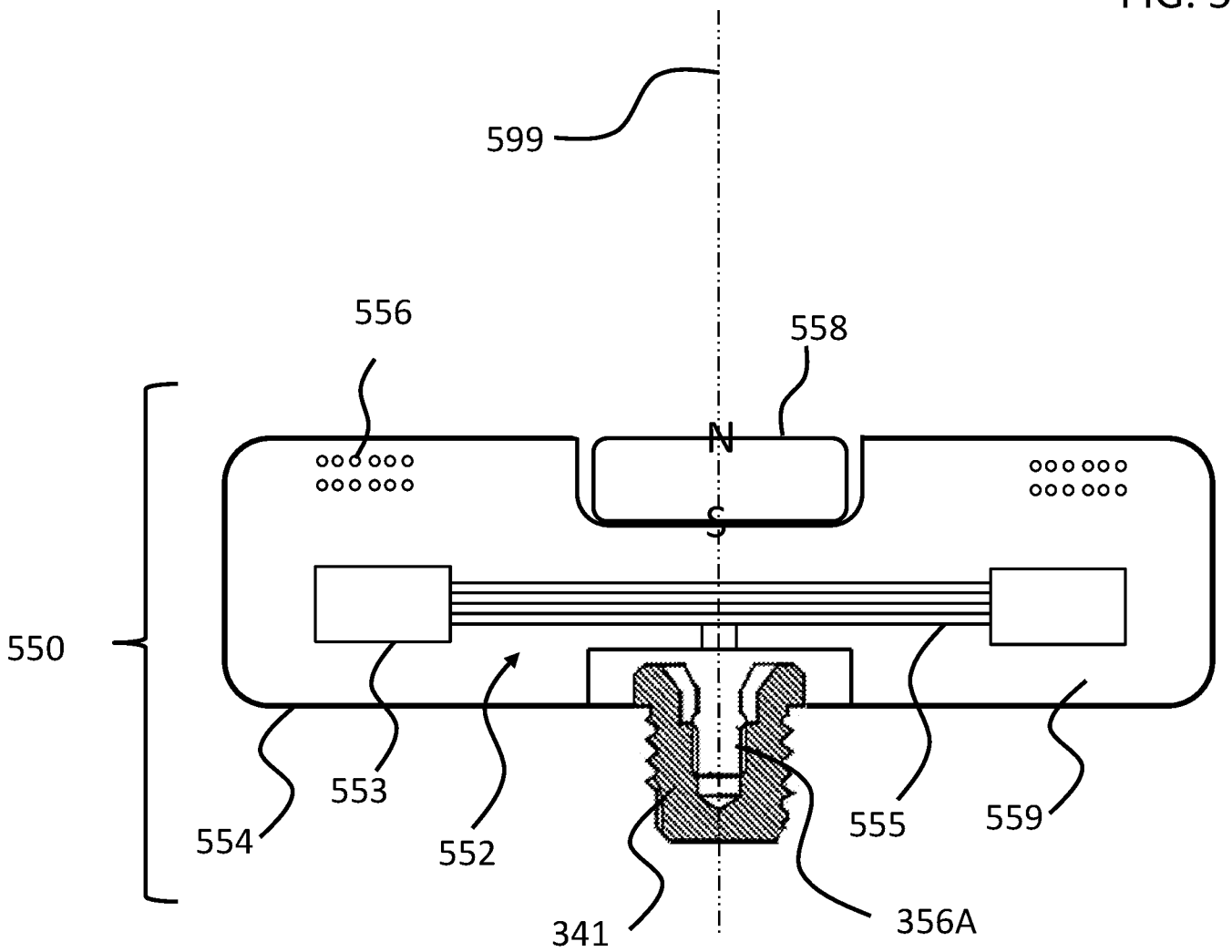

FIGS. 4 and 5 depict another exemplary embodiment of an implantable component usable in an active transcutaneous bone conduction device, here, implantable component 550. FIG. 4 depicts a side view of the implantable component 550 which includes housing 554 which entails two housing bodies made of titanium in an exemplary embodiment, welded together at seem 444 to form a hermetically sealed housing. FIG. 5 depicts a cross-sectional view of the implantable component 550.

In an exemplary embodiment, the implantable component 550 is used in the embodiment of FIG. 3B in place of implantable component 450. As can be seen, implantable component 550 combines an actuator 552 (corresponding with respect to functionality to actuator 452 detailed above) and the inductor or coil 556 (corresponding with respect to the functionality of the implanted RF receiver coil 456) into a single apparatus. Both actuator 552 and coil 556 are housed in the same housing 554. That is, as opposed to the implantable component 440 of FIG. 3B which has the implanted receiver coil 456 located in one housing and the vibrating actuator 452 in another, separate housing, the receiver coil 556 and the vibrating actuator 552 are located in the same housing 554 in the embodiment of FIG. 5. Briefly, it is noted that the vibrating actuator 552 includes a so-called counterweight/mass 553 that is supported by piezoelectric components 555. In the exemplary embodiment of FIG. 5, the piezoelectric components 555 flex upon the exposure of an electrical current thereto, thus moving the counterweight 553. In an exemplary embodiment, this movement creates vibrations that are ultimately transferred to the recipient to evoke a hearing percept.

Accordingly, in an exemplary embodiment, there is a hearing prosthesis, comprising an implantable component, such as implantable component 550 just detailed. In this exemplary embodiment, the implantable component includes a vibratory apparatus, such as by way of example only and not by way of limitation, the vibrating actuator 552 just detailed, as well as an inductance coil 556. In an exemplary embodiment, the vibratory apparatus 552 and the inductance coil 556 are encased in the same housing (e.g., housing 554). In an exemplary embodiment, the housing numeral 554 is made out of titanium and/or a titanium alloy. In an exemplary embodiment, with respect to the outer surface area of the housing 554, over 90% of the surface area comprises a titanium and/or a titanium alloy material. In an exemplary embodiment, again with respect to the outer surface area of the housing, over 91, 92, 93, 94, 95, 96, 97, 98, or 99% of the surface area of the housing comprises a titanium and/or a titanium alloy material. In an exemplary embodiment, 100% of the outer surface area of the housing comprises a titanium and/or a titanium alloy material. Note that this is with regard to the housing. As can be seen in the embodiment of FIG. 5, there is a magnet 558 located on an outside surface of the housing. The aforementioned values do not include this magnet. That is, in an exemplary embodiment, the embodiment of FIG. 5 can be an embodiment where 100% of the outer surface area of the housing comprises titanium and/or a titanium alloy material.

In an exemplary embodiment of the aforementioned arrangement, the implantable component 550 is configured such that a transcutaneous signal received by the inductance coil 556 through the titanium housing numeral 554 activates the vibratory apparatus 552 to evoke a hearing percept. In an exemplary embodiment, this entails vibratory bone conduction. That said, in an alternative embodiment, the vibratory apparatus 552 can be of a different configuration, and mechanically linked to a middle ear and/or the inner ear to evoke a mechanically induced hearing percept. That is, this general arrangement which has been described in terms of FIG. 5, can be applied to another type of hearing prostheses other than a bone conduction device (additional details are provided below).

As can be understood from the schematic of FIG. 5, in an exemplary embodiment, the housing numeral 554 entirely and completely encompasses the coil 556 and the vibratory apparatus 552, and is thus devoid of any feedthrough passages. This as contrasted to the device of FIG. 3B, where in at least some exemplary embodiments, a feedthrough is located in the housing numeral 454 so as to permit the electrical lead assembly 460 to communicate with the vibrating actuator 452 therein. Accordingly, in an exemplary embodiment, as noted above, 100% of the surface area of the housing 554 can entail titanium and/or a titanium alloy. According to an exemplary embodiment, the housing 554 can entail two monolithic components made of titanium and/or a titanium alloy that are welded together about a seam that extends about longitudinal axis 599. Accordingly, in an exemplary embodiment, there is an implantable component of a passive transcutaneous bone conduction device that does not include any feedthroughs.

It is briefly noted at this time that some and/or all of the components of the embodiment of FIG. 5 are at least generally rotationally symmetric about the longitudinal axis 559. In this regard, by way of example only and not by way of limitation, the magnet 558 is a disk magnet, and the coils 556 extend about the longitudinal axis in a circular fashion. Still further, the screw 356A is circular about the longitudinal axis 559. Back lines have been omitted for purposes of clarity.

Figure 6:
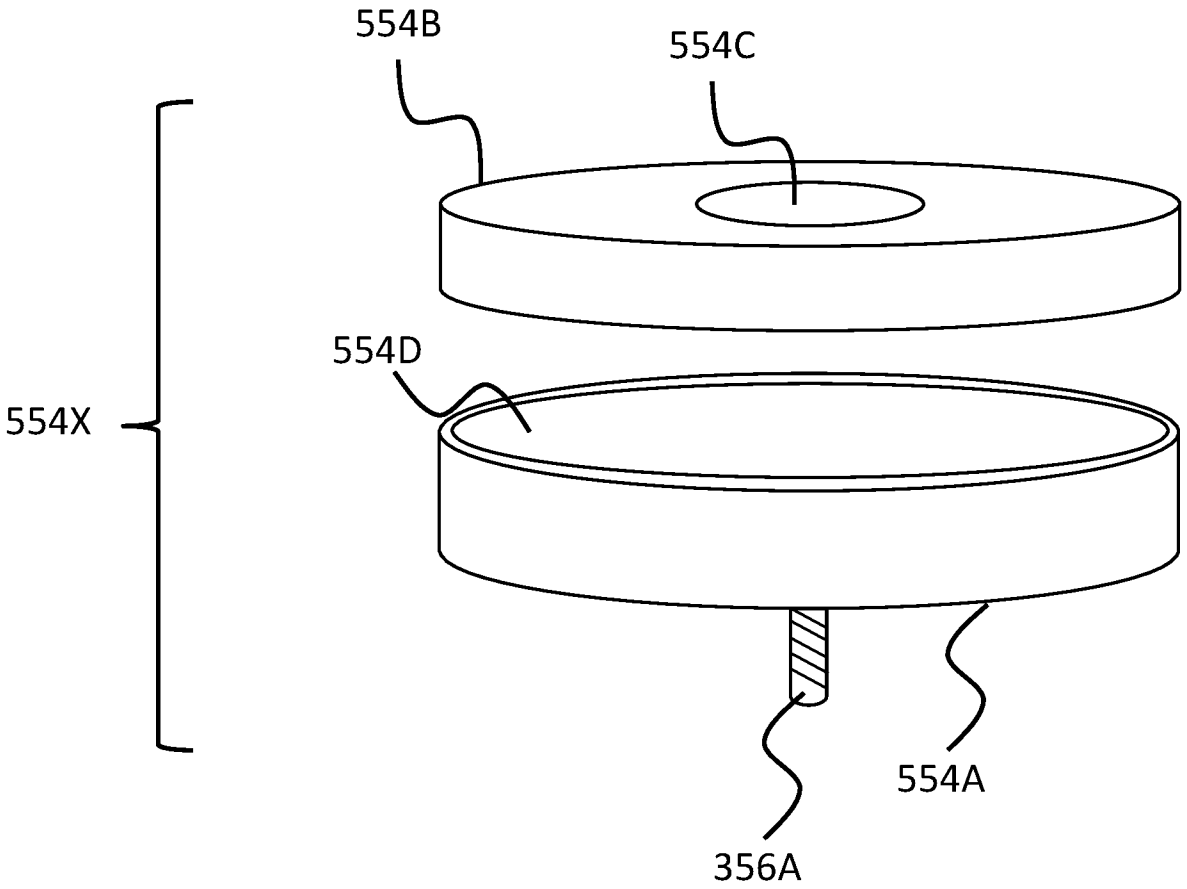
FIG. 6 is a schematic depicting component parts of the embodiment of FIGS. 4 and 5.

To this end, FIG. 6 depicts an exemplary pre-assembly of an embryonic housing 554X including bottom component 554A and top component 554B (with recess 554C being located at the top magnet 558 (not shown)). In an exemplary embodiment, the housing 554 is manufactured by placing the various components that will be housed therein into housing space 554D, and securing accordingly if such is utilitarian, and then welding top component to the bottom component about the seam that exists when the two components are together, thereby hermetically sealing the inside of the housing from the external environment, and establishing housing 554.

That said, some embodiments can include a housing that includes a feedthrough. Such an embodiment can include a housing where less than 100% of the surface area comprises titanium and/or titanium alloy, as noted above.

Figure 7:
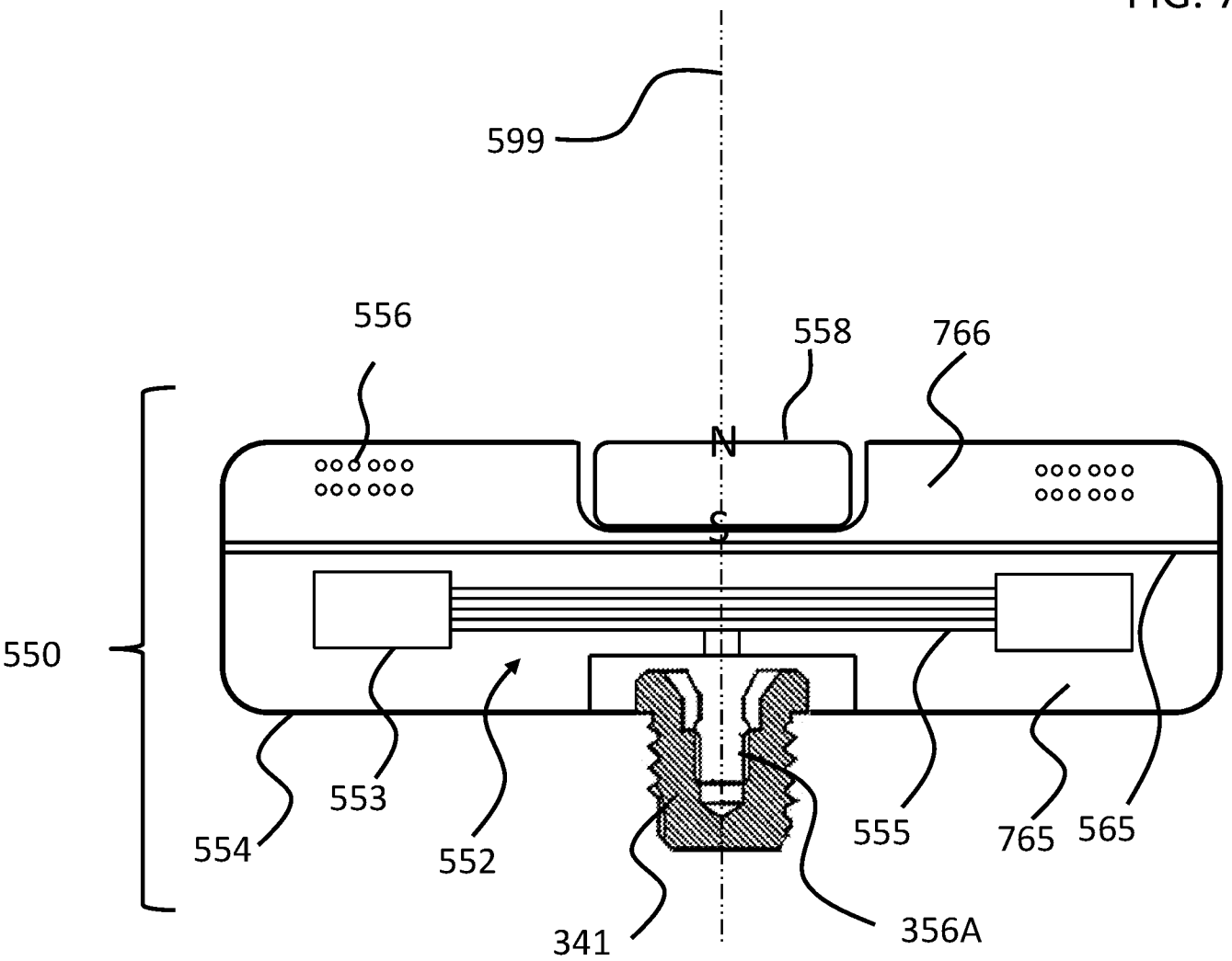
FIGS. 7 and 8 are schematics of some additional exemplary implantable components in accordance with at least some embodiments.

Also as noted above, in an exemplary embodiment, the interior space of the housing numeral 554 is hermetically sealed from the outside/ambient environment this can have utilitarian value with respect to implantable components 550 that are implanted in a human being, as this can prevent body fluids from encroaching or otherwise entering into the space 559 inside housing 554. In this regard, in the embodiment of FIG. 5 the coil 556 and the actuator 552 share the same hermetically isolated space. Here, the coil 556 and the actuator 552 are not hermetically isolated from one another. While the embodiment depicted in FIG. 5 depicts these two components of sharing the same space, in an alternate embodiment, the components can be spatially isolated from one another, as seen in FIG. 7. Here, wall 565 hermetically isolates the actuator 552 from the coil 556. In an exemplary embodiment, there is a feedthrough in wall 565 that permits signal communication between the coil 556 and the actuator 552. As will be described in greater detail below, the coil 556 and the actuator 552, or more specifically, the piezoelectric components 555 are part of the same circuit. In any event, an exemplary embodiment can include the coil 556 being located in a first hermetically sealed space within the housing, and the actuator 552 can be located in a second hermetically sealed space within the housing. Both are still, however, entirely and completely encompassed within the housing numeral 554. Note that the presence of a feedthrough in wall 565 can still be present with respect to a housing numeral 554 that is devoid of any feedthrough passages.

It is noted that while various embodiments described herein have been described in terms of a piezoelectric actuator, in some alternate embodiments, different types of actuators and/or transducers can be utilized, such as by way of example only and not by way of limitation, an electromagnetic actuator, as will be described in greater detail below with respect to an exemplary embodiment. Also, it is noted that in an exemplary embodiment, the housing material in some alternate embodiments can be made out of other biocompatible materials such as PEEK, thus replacing the titanium and/or a titanium alloy. In an exemplary embodiment, the housing is made of any biocompatible material that can enable the teachings detailed herein and/or variations thereof. Still further, in an exemplary embodiment, it is the outer surfaces of the housing that is made of any biocompatible material. In an exemplary embodiment, portions of the housing located beneath the outer surfaces may not necessarily be biocompatible. The teachings detailed herein can enable such a cause the biocompatible outer surfaces establish a barrier between such non-biocompatible materials and the ambient environment of the implant.

Note further that in an exemplary embodiment, two separate housings that are joined to each other can correspond to a single housing providing that an outer surface thereof contiguously establishes a housing surface. For example, the embodiment of FIG. 7 can be such that the space 766 is established by its own housing comprising the top portion of housing 554 and wall 565. Alternatively, space 765 can be established by its own housing comprising the bottom portion of housing 554 and the wall 565. Still further, both spaces can be established by their own separate housings in a scenario where there is an additional wall. In this regard, a scenario can exist where the coil 556 exists in its own separate housing and the actuator 552 also exist in its own separate housing, and the two separate housings are joined together to form a housing assembly, effectively establishing a single housing.

It is briefly noted that in an exemplary embodiment, the entirety of the coil 556 is located within a titanium housing.

Note that the embodiments detailed above have been described in terms of the top portion of the housing 554 (554B) being welded to the bottom portion of housing 554 (554A). In such an exemplary embodiment, this establishes a monolithic housing. Conversely, in an alternate embodiment, bottom portion of housing 554 is screwed onto to the top portion of housing 554, or vice versa. Alternatively and/or in addition to this, bottom portion of housing numeral 554 is glued to the top portion of housing 554. In this regard, the two components are separate components, and thus housing 554 is not a monolithic component. Accordingly, embodiments include housings that are not monolithic as well as housings that are monolithic.

Keeping with respect to the embodiment where the implantable component 550 can be utilized in the device of FIG. 3B (replacing implantable component 450) where coil 556 forms part of a transcutaneous inductance link between that coil and the coil (transmitter coil 442) in the external component 440. Accordingly, in an exemplary embodiment, the implantable component 550 includes a single housing 554 encompassing the actuator 552 and the coil 556, which coil 556 forms part of the transcutaneous link between the implantable component 550 and the external component 440.

As noted above, the actuator 552 can utilize piezoelectric material to form element 555. In some embodiments, the piezoelectric material is biocompatible, while in other embodiments the piezoelectric material is not biocompatible. The latter scenario can still have utilitarian value with respect to embodiments where the housing numeral 554 hermetically isolates the inside thereof from the ambient environment of the implantable component 550. It is further noted that in an exemplary embodiment, the coil 556 can be made of copper and/or a copper alloy in an exemplary embodiment, the coil 556 is made of at least 50% copper by weight. In an exemplary embodiment, the coil 556 is made up of at least 55% copper by weight. In an exemplary embodiment, the coil 556 is made up of at least 50, 55, 60, 65, 70, 75, 80, 85, 90, 91, 92, 93, 94, 95, 96, 97, 98, 99, or 100% by weight, or any value or range of values therebetween in 0.1% increments (e.g., 85.3%, 94.1%, 66.6% to 99.9%, etc.). The aforementioned numbers are with respect to all coils in the implantable component that are utilized to establish the aforementioned inductance link. This is distinguished from, for example, leads between the coils and the actuator 552. That said, in an alternate embodiment, the aforementioned values are also applicable to all electrically conducting components of the circuit that includes the coils 556 that are not part of the piezoelectric material 555.

While the above embodiments have generally been described in terms of an actuator (a device that creates movement when subjected to an electrical current), it is noted that embodiments also include transducers that generate an electrical current or otherwise produce an electrical current when exposed to movement. In this regard, any disclosure of an actuator herein also corresponds to a disclosure of a transducer, unless otherwise specified. Thus, any disclosure of a piezoelectric actuator herein corresponds to a disclosure of the piezoelectric transducer.

Still with reference to the embodiments of FIGS. 5, 6, and 7, as can be seen, these embodiments have the implant magnet 558 located outside of the housing 554. In an exemplary embodiment, the magnet 558 is permanently attached to the housing 554. In an alternate embodiment, the magnet 558 is removable from the housing 554. Such can have utilitarian value with respect to Mill compatibility. In this regard, in an exemplary embodiment, the magnet 558 can be removed without removing the housing 554 from the recipient. (In an exemplary embodiment, magnet 558 has a relatively thin (relative to the thickness of the magnet in the longitudinal direction (i.e., parallel to axis 599) biocompatible covering, such as a casing or wall).) In an exemplary embodiment, there is an aperture that extends through the center of the housing from one side to the other to enable a screw or bolt to be used to secure the housing to the bone fixture 341. In this exemplary embodiment, the housing is a doughnut shaped component that establishes a hermetic enclosure around the bolt. In an exemplary embodiment, the magnet itself could also be a donut-shaped magnet to enable the bolt to extend therethrough. In an exemplary embodiment, the magnet can be rigidly secured to the coupling/bone screw, so as to resist torque during an Mill process and/or make the magnet easily removable for head scans.

Figure 8:
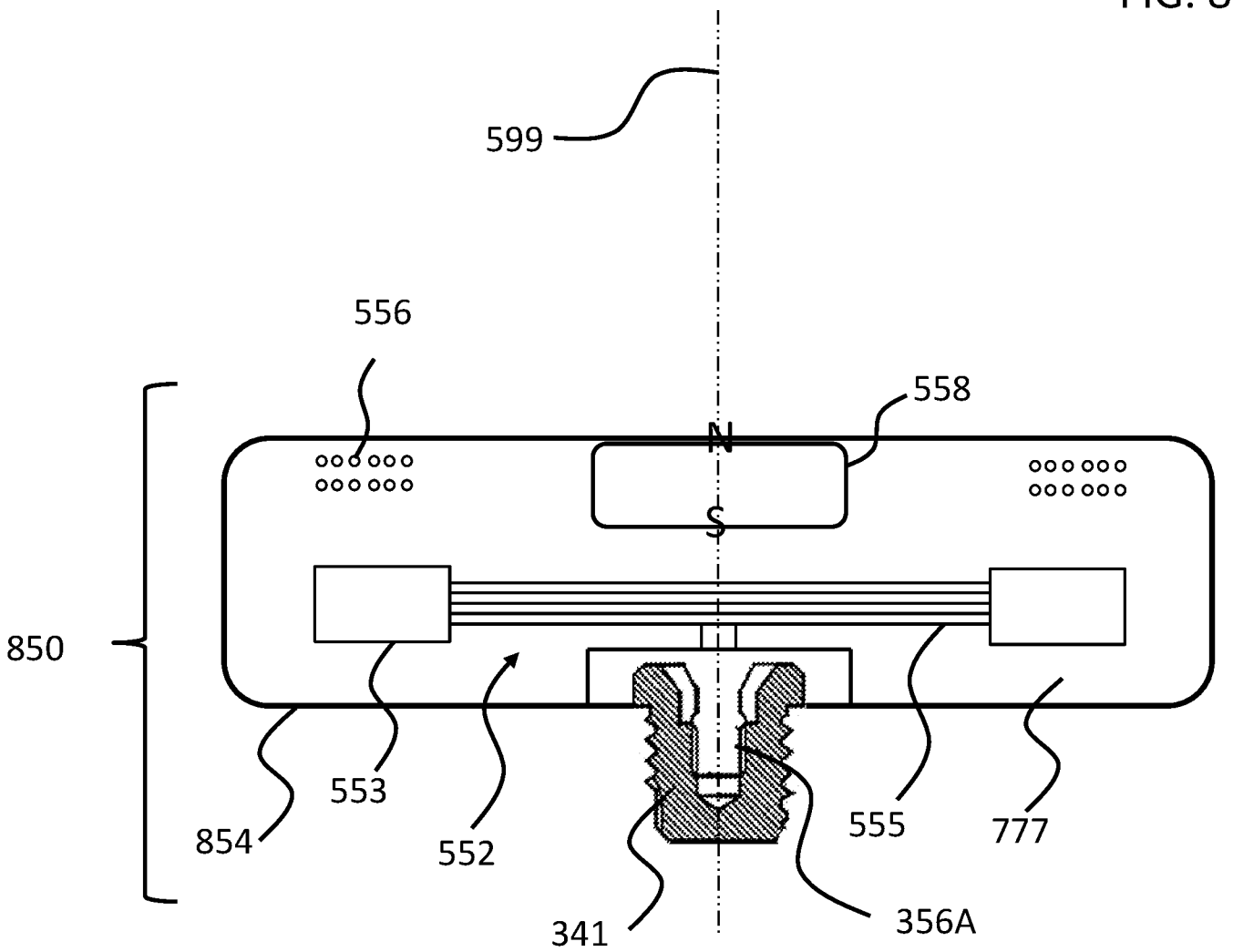

FIG. 8 depicts an alternate embodiment of the implantable component, implantable component 850. In this embodiment, the magnet 558 is located inside the housing 854. In an exemplary embodiment, the magnet 558 can be bolted or otherwise glued or otherwise mechanically retained to the upper wall of the housing 854. Accordingly, in an exemplary embodiment, magnet 558 is hermetically sealed within housing 854 (located in space 777), along with coil 556 and actuator 552.

Figure 9:
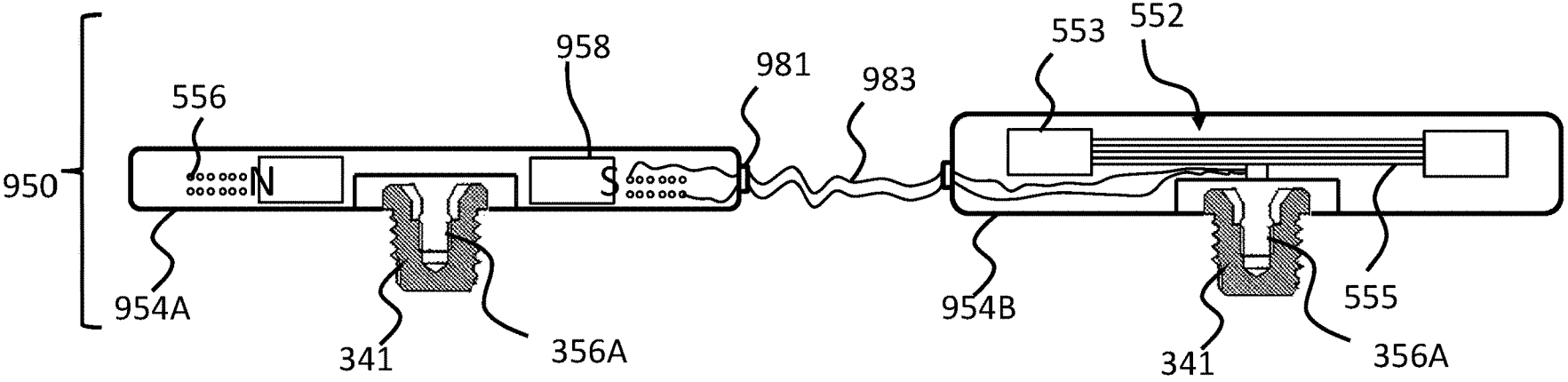
FIGS. 9 and 10 are schematics of some additional exemplary implantable components in accordance with at least some embodiments.

FIG. 9 depicts yet another alternate embodiment of an implantable component usable in the embodiment of FIG. 3B, implantable component 950. Here, implantable component 950 bifurcates the coil 556 and the actuator 552 into two separate housings, housing 954A, and housing 954B, respectively. This can have utilitarian value with respect to having housings that have a lower profile (as measured from the surface of the skull). By dividing the components between two separate housings, the heights of the housings can be lower than that which is the case with all the components in a single housing. Still further, in at least some exemplary embodiments, this can have utilitarian value with respect to reducing a footprint (i.e., the area adjacent the skull) of one or both components, which can have utilitarian value with respect to accommodating the curvature of the skull (i.e., by having a more limited footprint, less, if any gap between the outer surface of the skull in the bottom of the housing results). In an exemplary embodiment, the housings can have the features detailed above, in whole or in part. In this regard, as can be seen, the housings include feedthroughs 981 which permits signal communication via the leads 983 between the two housings. Accordingly, the housings 954A and 954B are such that 90% or more of the surface areas of the housings are made up of titanium and/or titanium alloy (or more, as detailed above). In an exemplary embodiment, there are connectors that enable one component to be replaced without removing the other component, which can have utilitarian value with respect to replacing a faulty actuator and/or a faulty coil, and/or upgrading one of the other without upgrading both. Accordingly, in an exemplary method entails removing one of the components and replacing it with a new component without removing one of the other components by disconnecting the coupling between the two components.

That said, in an alternate embodiment, the housings are made of PEEK or another type of biocompatible material. It is briefly noted that in the embodiment of FIG. 9, a bone fixture 341 is utilized as the interface with the bone that holds the housing 954A in position. As will be detailed below, in some exemplary embodiments, a bone fixture is not utilized (because the vibratory component is not located in the housing 954A).

FIG. 9 presents an alternate arrangement for the magnet that is utilized to magnetically couple external component 440 to the recipient. Here, as can be seen, magnet 958 is a doughnut magnet instead of a disk magnet. Any magnet arrangement having any orientation or clarity that can enable the teachings detailed herein can be utilized in at least some exemplary embodiments.

Figure 10:
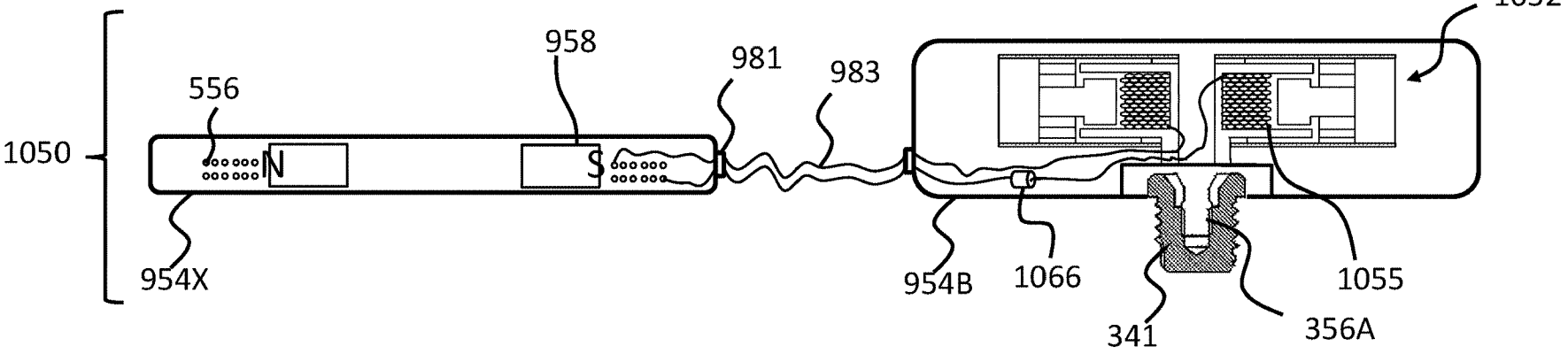

As noted above, embodiments of the teachings detailed herein are not limited to piezoelectric transducers. In this regard, FIG. 10 depicts an exemplary embodiment of an implantable component 1050 usable with the embodiment of FIG. 3B, which utilizes an electromagnetic transducer 1052. Briefly, transducer 1052 includes coils 1055 that generate a dynamic magnetic flux that interact with magnets of the transducer 1055. While the embodiment of FIG. 10 depicts the coils 556 and the transducer 1052 bifurcated between two separate housings, in some alternate embodiments, the coils 556 and the transducer 1052 can be housed in the same housing concomitant with the teachings of FIG. 5 (i.e., the piezoelectric transducer is replaced with the electromagnetic transducer 1052). As can be seen in FIG. 10, the coils 1055 of the electromagnetic transducer 1052 are in electrical communication with each other via leads 983 extending through the feedthroughs 981. It is noted that in this exemplary embodiment, an additional series component can be included in the form of a capacitor 1066 as can be seen. Additional details of this feature will be described in greater detail below. It is noted that while the embodiment of the electromagnetic actuator is disclosed as having the series capacitor 1066, in some alternate embodiments utilizing the electromagnetic actuator or piezoelectric actuator, such can also include a parallel capacitor (such can have utilitarian value wherein, for example, the piezoelectric component has a capacitance of about 100 nF to 2 μF). In an exemplary embodiment, the additional capacitor is configured to add about 100 nF to about 2 μF to the system, thereby establishing a resonant LC tank.

It is briefly noted that FIG. 10 depicts an exemplary embodiment where the housing 954X is flat bottomed, and the implantable component 1050 does not utilize a bone fixture to connect housing 954X to the bone. Again, as mentioned above, because the vibratory apparatus is not located in housing 954X, the utilitarian value of utilizing a bone fixture to secure that housing to the bone is not present. In an exemplary embodiment, sutures or the like or less invasive bone screws are utilized to adhere housing 954X to bone.

Figure 11:
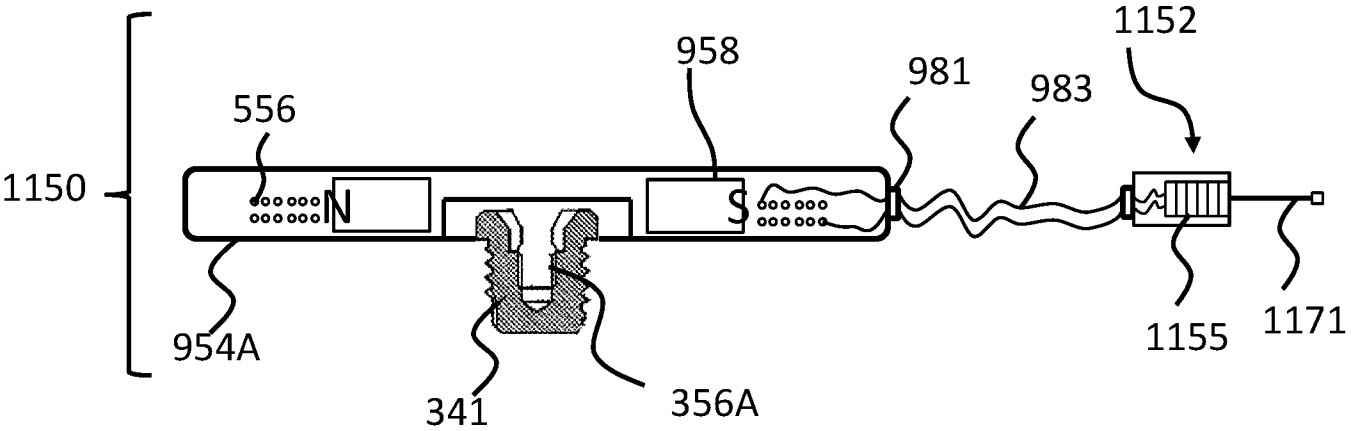
FIG. 11 is a schematic depicting another exemplary embodiment of an implantable component.

Embodiments detailed above have generally focused on the so-called bone conduction device, where a mass moves in an oscillatory manner so as to result in the creation of vibrations that are then transferred from the housings containing the actuators to the bone of the recipient, which vibrations travel along the bone to the inner ear of the recipient, to evoke a hearing percept via bone conduction. That said, in some alternate embodiments, the teachings detailed herein are also applicable to other types of hearing prostheses, such as by way of example only and not by way of limitation, a middle ear implant or a direct acoustic cochlear stimulator, etc. In this regard, referring now to FIG. 11, there is an exemplary embodiment of an implantable component 1150 that is usable in the embodiment of FIG. 3B. Here, the coils 556 are in communication via leads 983 with a direct acoustic piezoelectric actuator 1152. The leads 983 transfer current to the piezo stack 1155, which causes the piezoelectric material to expand and/or contract, which in turn causes the rod 1171 to move back and forth. When the rod 1171 is connected to the ossicles and/or to the oval window of the cochlea, a hearing percept can be evoked via movement of the rod 1171 back and forth, which moves the pertinent components of the recipients hearing system back and forth. (Note that the additional capacitor 1066 can be utilized with this embodiment—the embodiment of FIG. 11—as well (as is the case with other embodiments).)

While various embodiments detailed above have been described in terms of the transducer being an actuator, where electrical input is provided to the transducer so as to create vibrations and/or mechanical movement, in an alternate embodiment, the system is a passive system, which receives vibrations or otherwise accelerations from the recipient, and transduces those received vibrations/accelerations into an electrical signal output utilized for diagnostic purposes and/or other purposes and/or for the generation of electricity so as to power another implantable component or for any other reason that might have utilitarian value.

Figure 12:
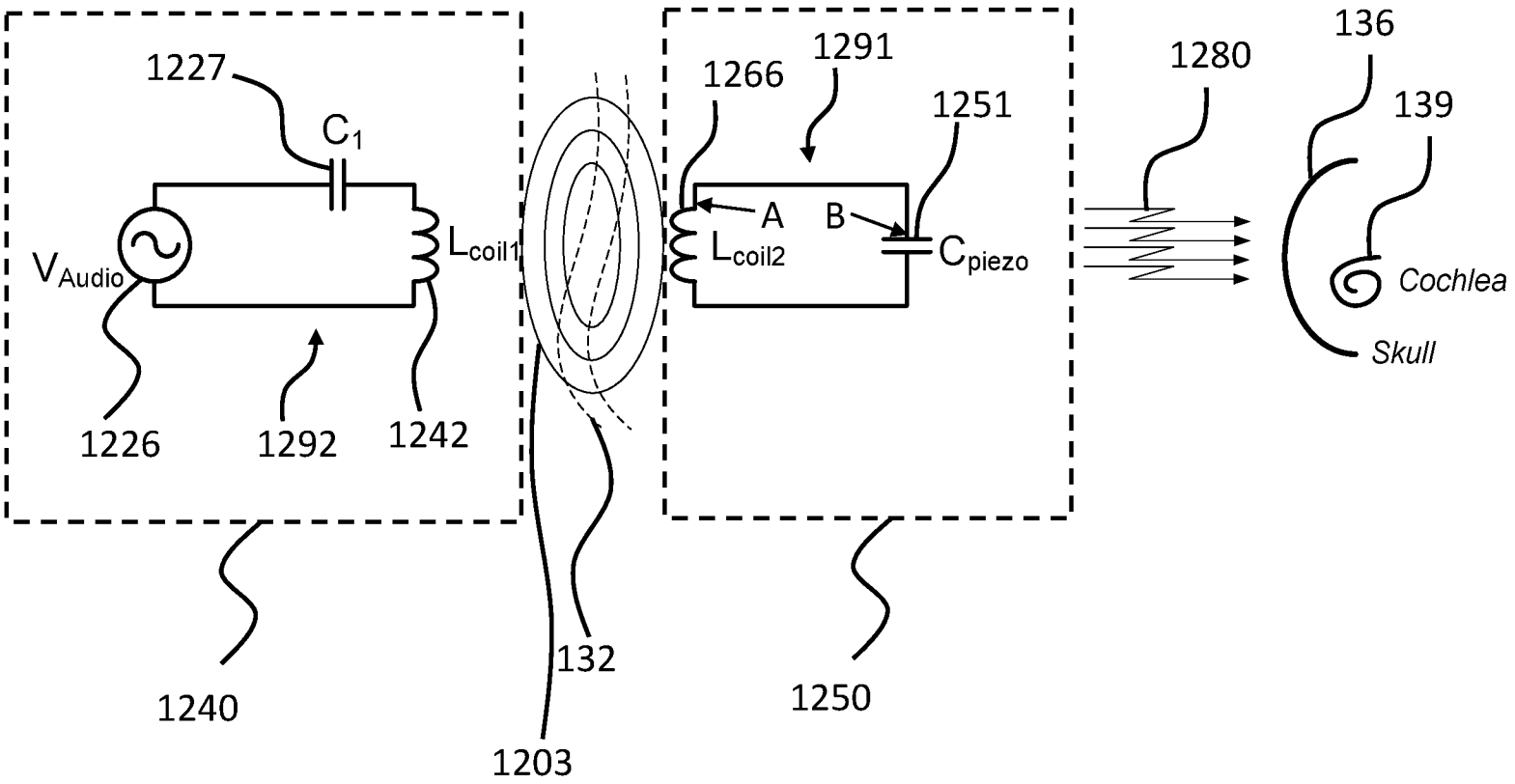
FIGS. 12 and 13 depict functional schematics detailing a principle of operation along with the rudimentary circuit diagrams according to some embodiments detailed herein.

FIG. 12 presents a functional schematic of an exemplary embodiment that corresponds to an implementation of at least some of the embodiments detailed above, at least with respect to those that utilize a piezoelectric material in the transducer. Here, the external component is represented by box 1240, corresponding to the external component 440 of FIG. 3B, and the implantable component is represented by box 1250, corresponding to the applicable implantable components detailed above. In an exemplary embodiment, external component 1240 corresponds to external component 440 detailed above with respect to FIG. 3B. In this exemplary embodiment, implantable component 1250 can correspond to any of the implantable components detailed herein, such as by way of example only and not by way of limitation, implantable component 550 detailed above with respect to FIG. 5. External component 1240 provides a schematic of an electrical circuit 1292. In this exemplary schematic, circuit 1292 includes audio input voltage source 1226, which can correspond to, for example, sound input element 126 detailed above. Circuit 1292 further includes capacitor 1227 and coil 1242, which can be an inductance coil corresponding to coil 442 detailed above. It is noted that additional components can be included in the circuit as well although in other embodiments, the circuit is at least generally limited to those components presented in FIG. 12. In an exemplary embodiment, the circuit 1292 is a circuit consisting essentially of coil 1242, capacitive component 1227, the voltage source 1226, which can correspond to a sound capture device (and/or in some alternate embodiments, input from an electronic component that provides a signal that is based on sound, such as the output of a so-called smart phone (more on this below)) and the wiring electrically coupling those components together.

In an exemplary embodiment, component 1250 is an implantable passive resident component.

In an exemplary embodiment, sound that is captured by microphone 1226 (the voltage source) induces a current in the circuit 1292 that ultimately results in an inductance field being generated at coil 1242. This inductance field is transferred via the transcutaneous inductance link detailed above through skin 132 to circuit 1291.

Circuit 1291 includes an inductance coil 1266, which can correspond to the inductance coil 556 of FIG. 5. Circuit 1291 also includes a capacitor 1251. In an exemplary embodiment, the capacitor corresponds to the piezoelectric component 555 of actuator 554. (It is briefly noted that the phrase "piezoelectric component" includes both a single block of piezoelectric material and a plurality of separate blocks of piezoelectric material. That is, the phrase "piezoelectric component" is not limited to just a single portion of the piezoelectric actuator.) As with circuit 1292, in some embodiments, additional components can be located in or otherwise be a part of circuit 1291. That said, in some alternative embodiments, the circuit 1291 is at least effectively limited to that seen in FIG. 12 (where the lines depict wiring between 1266 and 1251, which, in some embodiments, corresponds to copper or coper alloy electrical wiring). In an exemplary embodiment, the circuit 1291 is a circuit consisting essentially of coil 1266, piezoelectric component 1251 and the wiring that is electrically coupling those two components together. In at least some exemplary embodiments, the piezoelectric component corresponds to a capacitor or is the equivalent of a capacitor.

In an exemplary embodiment, circuit 1291 and/or circuit 1292 is an LC circuit that has an electrical self-resonant frequency of below 20 kHz. Additional ramifications of such will be described in greater detail below. That said, in an exemplary embodiment, circuit 1291 and/or circuit 1292 is an LC circuit that has an electrical self-resonant frequency of below 10,000 Hz. Still further, in an exemplary embodiment, circuit 1291 and/or circuit 1292 is an LC circuit that has an electrical self-resonant frequency of below 20 kHz, 19.5 kHz, 19 kHz, 18.5 kHz, 18 kHz, 17.5 kHz, 17 kHz, 16.5 kHz, 16 kHz, 15.5 kHz, 15 kHz, 14.5 kHz, 14 kHz, 13.5 kHz, 13 kHz, 12.5 kHz, 12 kHz, 11.5 kHz, 11 kHz, 10.5 kHz, 10 kHz, 9.5 kHz, 9 kHz, 8.5 kHz, 8 kHz, 7.5 kHz, 7 kHz, 6.5 kHz, 6 kHz, 5.5 kHz, 5 kHz, 4.5 kHz, 4 kHz, 3.5 kHz, 3 kHz, 2.5 kHz, 2 kHz, 1.5 kHz, 1 kHz or any value between any of these values in 0.1 kHz increments.

Figure 13:
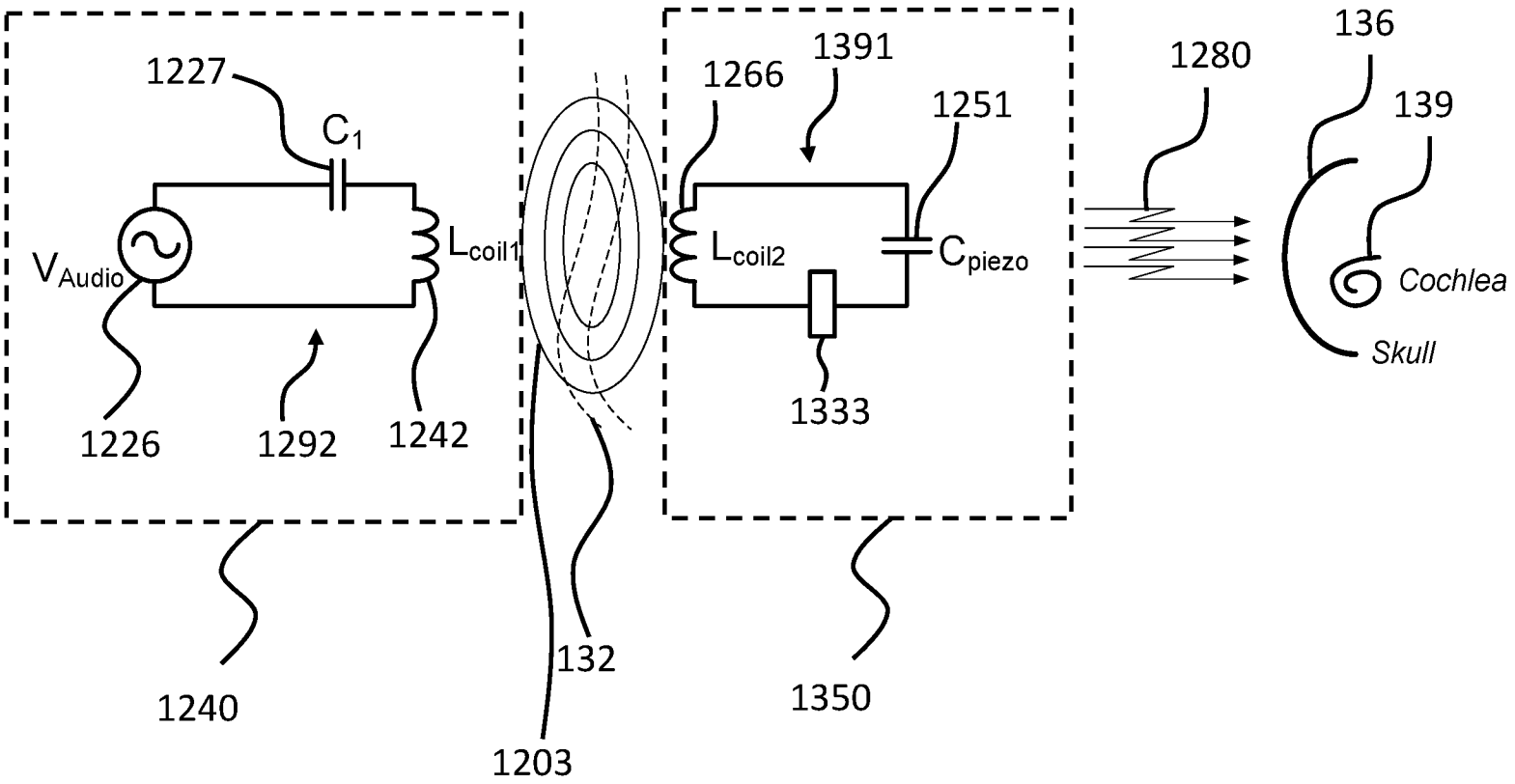

Accordingly, in an exemplary embodiment, there is a prosthesis, such as any of the prostheses detailed herein and/or variations thereof, that includes an implantable component, such as the implantable component represented by box 1250. The implantable component includes an LC circuit. Here, the LC circuit is established by the coil 1266 and the piezoelectric component 1251, where the piezoelectric material forms at least part of the capacitance portion of that LC circuit. In some embodiments, the piezoelectric material forms the entirety of the capacitance portion of the LC circuit, while in other embodiments, the piezoelectric material forms only a portion of the capacitance portion of the LC circuit. In this regard, FIG. 13 depicts an alternate embodiment of an implantable component, implantable component 1350, which include circuit 1391, which is identical to circuit 1291 detailed above, except that it includes a capacitor 1333, that is separate and distinct from the piezoelectric material 1251 (but is part of the tank circuit). That is, circuit 1391 includes a dedicated, separate capacitor 1333. Thus, in an exemplary embodiment, there is an LC circuit that comprises only an inductance coil and one or more components corresponding to capacitance components.

Consistent with the teachings detailed above where the piezoelectric material forms part of a piezoelectric transducer, in the exemplary embodiments of FIGS. 12 and 13, when implemented with the embodiments of, for example, FIG. 5, FIG. 7, FIG. 8, FIG. 9 and FIG. 11, etc., the piezo 1251 forms part of an actuator (e.g., actuator 552, 1152) configured to output energy such as a force to tissue of the recipient while the implantable component is implanted in the recipient. This can be done with respect to bone conduction vibration, where the actuator creates vibrations which are transmitted out of the housing to the bone of the recipient. This can also be done with respect to the middle ear implant/DACI of the embodiment of FIG. 11, where the actuator 1152 imparts a force in an oscillating manner on to a middle ear component and/or an inner ear component of the recipient. In at least some exemplary embodiments, the piezoelectric material is a material that expands and/or contracts upon the application of an electromagnetic field to the inductor of the LC circuit (e.g., circuit 1291). In this regard, in an exemplary embodiment, a magnetic field and/or an electromagnetic field can be created using coil 1242 of the external component 1240. This creates an inductance field 1203 that is transmitted through skin 132 of the recipient. This inductance field 1203 induces an electric current to flow through coil 1266, and thus through circuit 1291. This electric current travels to the piezo 1251, which causes the piezoelectric material to expand and/or contract or otherwise deform so as to create movement and thus move the mass/counterweight to which the piezoelectric material is attached. Thus, the piezoelectric material expands and/or contracts due to direct application of the current induced at the inductor by the magnetic field to the piezoelectric material. This movement creates vibrations 1280 that are transmitted from the housing of the implantable component 1250 to the skull 136 and then to the cochlea 139 to evoke a hearing percept. In an exemplary embodiment, the current and voltage and frequency of the electricity as measured just after the "end" of the coil is exactly the same as that measured just before the piezoelectric material (e.g., locations "A" and "B," respectively, in FIG. 12), other than the influence on the effects of the wire/lead between those two points. In an exemplary embodiment, the transcutaneous coupled link 1203 is a closely coupled magnetic near field link.

It is noted that in the exemplary embodiment of FIG. 5, the piezoelectric material 555 comprises a so-called piezoelectric bender. In an alternate embodiment, a piezoelectric stack expands and/or contracts upon the application of the electric current. An exemplary embodiment is the piezoelectric stack 1155 of the actuator 1152 of the embodiment of FIG. 11. Any implementation of a piezoelectric material that can enable the teachings detailed herein and/or variations thereof to be practiced can be utilized in at least some exemplary embodiments.

Consistent with the teachings of FIGS. 5, 7, and 8, where housing 554, etc., houses both the coil and the actuator, the LC circuit of such embodiments is entirely contained and hermetically sealed in a titanium housing without openings through the titanium housing. Conversely, in keeping with the embodiments of FIGS. 9, 10, and 11, the LC circuit of such embodiments is bifurcated between two separate housings, one of which is a titanium housing with only one opening (the opening for feedthrough 981), which housing encloses coil 556 and/or magnet 558/958.

Note further that while the embodiment of FIG. 10 depicts the electromagnetic actuator 1052 located in a separate housing 954B from the housing 954A that envelops the coil 556, in an alternate embodiment, the electromagnetic actuator 1052 can be located in the same housing as the coil 556. In this regard, with respect to embodiments that utilize electromagnetic transducer, pertinent circuits for such an embodiment could include an inductance coil 1266, which can correspond to the inductance coil 556 of FIG. 5. With reference to FIG. 10, such a circuit could include capacitor 1066 and the transducer 1052, along with the pertinent wiring and feedthroughs in embodiments that utilize two or more housings to separately house the various components. In an exemplary embodiment, there is an exemplary circuit consisting essentially of coil 1266, electromagnetic transducer 1052, and the wiring that is electrically coupling those two components together. It is noted that such a circuit can also include a circuit that includes feedthroughs as that does not alter the basic characteristics of the device.

Still with reference to FIG. 12, in an exemplary embodiment, there is a prosthesis, comprising an implantable component, such as that functionally represented by 1250. This implantable component includes a transducer configured to output a mechanical force when an electrical current is applied thereto. In an exemplary embodiment, the transducer can correspond to any of the piezoelectric transducers detailed herein and/or variations thereof in this exemplary embodiment, a circuit of which the transducer is a part, such as circuit 1291, is entirely made up of passive electronic components. For example, in the embodiment of FIG. 12, the circuit 1291 includes only the coil 1266, the piezoelectric material 1251, and the accompanying wiring that wires the coil 1266 to the piezoelectric material 1251. In some exemplary embodiments, such as that depicted in FIG. 13, the circuit can include an additional capacitor 1303, which is also a passive electronic component.

In an exemplary embodiment, the implantable component is completely devoid of semiconductor components, or at least this is the case with respect to the circuit of which the actuator is a part.

In an exemplary embodiment, no components are present that extract power to function in the implantable component, or at least with respect to the circuit of which the actuator is a part. By way of example only and not by way of limitation, the implantable component and/or the circuit of which the actuator is a part is completely devoid of such components as diodes. Accordingly, in an exemplary embodiment, the implantable component is a component that is completely devoid of integrated circuits therein. More specifically, in an exemplary embodiment, the circuit of which the actuator is a part is completely devoid of integrated circuits.

A passive electronic component is a component that does not require energy to operate, except for the available alternating current (AC) circuit that it is connected to. A passive component is not capable of power gain and is not a source of energy. Generally, passive components are not able to increase the power of a signal nor are they able to amplify the signal. However, they can increase current or voltage via storage of electrical energy from resonant frequencies or by a transformer that acts like an electrical isolator. In an exemplary embodiment, the passive circuit is a lossless circuit, in that it does not have an input or output net power flow.

Passive components that use circuit architecture would include inductors, resistors, voltage and current sources, capacitors, and transformers. Likewise, passive filter are comprised of four elementary linear elements that include an inductor, capacitor, resistor, and transformer. Some high-tech passive filters can have non-linear elements like a transmission line.

Corollary to the above, in an exemplary embodiment, there is a prosthesis, such as any of those detailed herein and/or variations thereof, that includes an implantable component, such as implantable component 550, or that represented by the functional diagram in FIGS. 12 and 13, that is devoid of any integrated circuits. Still further, in an exemplary embodiment, there is an implantable component of an active transcutaneous bone conduction device that does not include any electronic assemblies.

Moreover, in view of the fact that at least some exemplary embodiments are made utilizing copper inductance coils (e.g., enameled copper wire), as opposed to, for example, platinum inductance coils or gold inductance coils, an exemplary embodiment includes an implantable component, such as implantable component 550 that is represented by functional diagram 1250, that is entirely devoid of precious metals. In an exemplary embodiment, all circuits that make up or otherwise include the actuator (transducer) and the coil are entirely devoid of precious metals. In an exemplary embodiment, all circuits that make up or otherwise include the actuator (transducer) and the coil include no more than as a percentage of total weight of the material making up such circuit, 10%, 9%, 8%, 7%, 6%, 5%, 4%, 3%, 2%, 1%, 0.5%, 0.25%, 0.1%, or 0.05% precious metals. Accordingly, in an exemplary embodiment, there is an implantable component of a hearing prosthesis that utilizes a transcutaneous inductance link, where there is no platinum coil implanted in the recipient.

That said, in an alternate embodiment, it is the implantable inductance coil (e.g., represented by coil 1266 of FIG. 12) that is devoid of precious metals. That said, in some embodiments, a limited use of precious metals can be utilized. In this regard, in an exemplary embodiment, the implantable inductance coil is substantially entirely devoid of precious metals.

In an exemplary embodiment, the material that makes up the coils that make up the implantable inductance coil include no more than as a percentage of total weight of the material, 10%, 9%, 8%, 7%, 6%, 5%, 4%, 3%, 2%, 1%, 0.5%, 0.25%, 0.1%, or 0.05% precious metals.

It is noted that in some exemplary embodiments, gold or platinum contacts of the circuit can be utilized. Thus, in an exemplary embodiment, noncontact components of the circuit of the implantable component are entirely devoid of precious metals were at least substantially entirely devoid of precious metals. In this regard, the aforementioned percentages can apply to such an embodiment.

It is noted that while these teachings have been directed towards the implantable component, these teachings are also applicable to the external component. Accordingly, it is noted that in at least some exemplary embodiments, any disclosure of the features associated with the circuit of the implantable component also corresponds to a disclosure of the circuit of the external component.

It is noted that in an exemplary embodiment, the external inductance coil 1242 and/or 1266 is a 500 turn copper coil of 200 micrometers in diameter (diameter of the wire of the coil). In an exemplary embodiment, coils are more than 100 turns, more than 200 turns, more than 300 turns, more than 400 turns, more than 500 turns, more than 600 turns, more than 700 turns, more than 800 turns, more than 900 turns, or more than 1000 turns.

Embodiments that utilize the above-noted LC circuit can have utilitarian value with respect to the establishment of a transcutaneous link at certain frequencies relative to other frequencies but are typically utilized in the art. By way of example only and not by way of limitation, hearing prostheses typically utilize transcutaneous links that operate in the megahertz frequency range. Conversely, according to at least some exemplary embodiments, there is a hearing prosthesis that comprises an external component, such as external component 440 detailed above with respect to FIG. 3B. The external component includes an inductance coil, concomitant with the embodiment of FIG. 12. The hearing prosthesis further includes an implantable component, such as implantable component 550. The implantable component also includes an inductance coil, concomitant with the embodiment of FIG. 12. In an exemplary embodiment, the hearing prosthesis is configured to establish a transcutaneous electromagnetic link between the implantable component and the external component at very low frequencies and/or lower, wherein the implantable component includes an actuator that is driven by the link to evoke a hearing percept. As used herein, very low frequency entails the range of 3-300 kHz, consistent with the use of this phrase in the art. In an exemplary embodiment, the transcutaneous link that is establish corresponds to frequencies of sound frequencies/audio frequencies (below 20 kHz), albeit with respect to an electromagnetic link, as opposed to mechanical/acoustic vibration. That is, the inductance link is a link that is established at frequencies below 20 kHz. It is an active link in that the link is created by active components that generate an output signal that causes an inductance current in the external coil 1242 that induces current in the implanted coil 1266. Accordingly, in an exemplary embodiment, the transcutaneous link is not operated at radio frequencies. Still further, accordingly, in an exemplary embodiment, the data transmitted from the external component 1240 to the implantable component 1250 utilized to evoke hearing percepts is not converted to radio frequencies. In an exemplary embodiment, the data is not converted whatsoever—the frequency of the captured sound corresponds to the frequency of the inductance link. Corollary to this is that in this exemplary embodiment, the link is an analog link as opposed to a digital link.

In an exemplary embodiment, the hearing prosthesis is configured to establish a transcutaneous electromagnetic link between the implantable component and the external component at frequencies of no more than 1 kHz, 1.5 kHz, 2 kHz, 2.5 kHz, 3.0 kHz, 3.5 kHz, 4.0 kHz, 4.5 kHz, 5 kHz, 5.5 kHz, 6 kHz, 6.5 kHz, 7 kHz, 7.5 kHz, 8.0 kHz, 9 kHz, 10 kHz, 11 kHz, 12 kHz, 13 kHz, 14 kHz, 15 kHz, 16 kHz, 17 kHz, 18 kHz, 19 kHz or 20 kHz or any value or range of values therebetween in 1 kHz increments. In some such exemplary embodiments, the implantable component includes an actuator that is driven by the link to evoke a hearing percept at those frequencies. It is further noted that in some embodiments, the circuit 1292 and/or 1291 is an LC resonant circuit tuned to one of the aforementioned frequencies. In this regard, in an exemplary embodiment, one or both of these circuits 1291 and/or 1292 are tuned to a frequency in the audio spectrum.

In an exemplary embodiment, the current that is induced in the coil 1266 is an alternating coil that has a frequency of the aforementioned frequencies. In an exemplary embodiment, the actuator of the implantable component (e.g., actuator 552, etc.), represented by piezoelectric material component 1251 in FIG. 12, vibrates when the transcutaneous link 1203 is present. The actuator vibrates at the frequency of the transcutaneous link 1203. In this regard, the actuator is configured to vibrate at the very low frequencies and lower. Thus, in an exemplary embodiment the hearing prosthesis is configured to establish an electromagnetic link entirely at audio frequencies to operate the vibratory apparatus to evoke a hearing prosthesis.

In view of the above, in an exemplary embodiment, there is an auditory prosthesis, comprising an external assembly, including a first inductance coil, such as coil 1242, and an active electronic device, such as the Vaudio 1226 of FIG. 12, in signal communication with the first inductance coil. Still further, this exemplary embodiment, includes an implantable component made up of passive electronic components including a transducer (e.g., element 1251) configured to output mechanical energy when an electrical current is applied thereto, and a second inductance coil (e.g., coil 1266) that is part of a first LC resonant circuit (e.g., circuit 1291) tuned to a frequency in the audio spectrum, wherein the first and second inductance coils form a transcutaneous coupled link.

As will be described in greater detail below, in an exemplary embodiment, the first inductance coil (coil 1242) is energized by a signal outputted by active electronic device (e.g., a smartphone or another hand-held consumer electronics device (e.g., an MP3 player, etc.) to generate an alternating magnetic field. Still further, in view of the above, in an exemplary embodiment, the aforementioned second inductance coil 1242 is configured to receive an alternating magnetic field having frequencies in the audio spectrum (e.g., below 20 kHz). Still further, the aforementioned transducer (element 1251) is configured to vibrate at the frequencies and amplitudes of the alternating magnetic field received by the second inductance coil (e.g., 1266) (thus evoking a hearing percept based on output at those frequencies and amplitudes). Thus, as will be understood, in at least some exemplary embodiments, the aforementioned second inductance coil is configured to receive an electromagnetic radiated field having frequencies in the audio spectrum, and the transducer 1251 is configured to vibrate at the frequencies and amplitudes of the electromagnetic radiated field received by the second inductance coil 1266 and the transcutaneous coupled link 1203 operates to supply the electromagnetic radiation received by the second inductance coil 1266.

With respect to embodiments that utilize a piezoelectric actuator that expands and/or contracts when exposed to an electrical current, in an exemplary embodiment, the piezoelectric material expands and/or contracts at a frequency and/or amplitude corresponding to a frequency and/or amplitude of the electromagnetic field to which the coil 1266 is exposed. For example, if the transcutaneous link is operating at a frequency of 1100 Hz, the piezoelectric material will expand and/or contract at 1100 Hz. Also by way of example, if the transcutaneous link is operating at a magnitude of 3, the piezoelectric material will expand and/or contract with a corresponding magnitude. In at least some exemplary embodiments, this will output a vibration by the implantable component of 1100 Hz so as to evoke a hearing percept at that frequency and/or amplitude. Thus, in an exemplary embodiment, there is a prosthesis according to the teachings detailed herein where the piezoelectric material thereof expands and/or contracts at a frequency and/or amplitude corresponding to a frequency and/or amplitude of a magnetic field to which the inductor of the LC circuit is exposed.

In view of the above, it is to be understood that in an exemplary embodiment, there is a prosthesis that includes an implantable component that includes an inductance coil configured to receive electromagnetic radiation having frequencies in the audio spectrum. The inductance coil is part of a circuit that includes a transducer, wherein the transducer configured to vibrate at the frequencies of the electromagnetic radiation received by the inductance coil.

It is noted that in an exemplary embodiment, the magnetic field and/or electromagnetic field generated by coil 1242 is an alternating magnetic field and/or electromagnetic field. In an exemplary embodiment, the piezoelectric material expands and/or contracts due to direct application of the current induced at the inductor by the alternating magnetic field and/or electromagnetic field generated by coil 1242.

In at least some exemplary embodiments, the actuator of the implantable component (represented by element 1251 of FIG. 12) is powered entirely and solely and directly by current induced in the coil by the inductance link. In an exemplary embodiment, the implantable component is devoid of batteries.

In at least some exemplary embodiments, the actuator of the implantable component has at least one resonant frequency at a value less than 4000 Hz. In an exemplary embodiment, the actuator of the implantable component has at least one resonant frequency at a value less than 1000 Hz, 1250 Hz, 1500 Hz, 1750 Hz, 2000 Hz, 2250 Hz, 2500 Hz, 3000 Hz, 3500 Hz, 4000 Hz, 4500 Hz, 5000 Hz, or any value or range of values therebetween in 1 Hz increments.

As noted above, in an exemplary embodiment, the coil 1266 of the implantable component 1250 is a copper coil in this regard, by way of example only and not by way of limitation, the coil 1266 has a weight percent by copper of at least 60%, 65%, 70%, 75%, 80%, 85%, 90%, 95%, or 100% or any value or range of values therebetween in 1% increments.

In an exemplary embodiment, the titanium implantable component of the hearing prostheses detailed herein is protected from electromagnetic interference (EMI) at frequencies above 50 kHz. In an exemplary embodiment, the implantable component of the hearing prostheses detailed herein is protected from electromagnetic interference (EMI) at frequencies above 10 kHz, 15 kHz, 20 kHz, 25 kHz, 30 kHz, 35 kHz, 40 kHz, 45 kHz, 50 kHz, 55 kHz, 60 kHz, 65 kHz, 70 kHz, 75 kHz, 80 kHz, 85 kHz, 90 kHz, 95 kHz, or 100 kHz, or any value or range of values therebetween in 1 kHz increments. In an exemplary embodiment, there is perfect EMI shielding for frequencies above 50 kHz. That said, in at least some exemplary embodiments, one or two or three or more transient voltage suppression (TVS) diodes or transorbs may be located in the circuits to protect the actuator from over voltages.

In view of the above, in an exemplary embodiment, there is a transcutaneous bone conduction device such as any of those described herein that includes a single implanted housing (i.e., there is only one housing). In an exemplary embodiment, there are only one, two, three, four, five, six, or seven electronic components located in that housing and no more. Instead of platinum wiring and/or platinum coils, non-precious metals are utilized for the internal wiring and the internal coils of the implanted component. In an exemplary embodiment, the aforementioned transcutaneous bone conduction device with the single implanted housing is a passive transcutaneous bone conduction device. In an exemplary embodiment, the aforementioned transcutaneous bone conduction device with the single implanted housing is an active transcutaneous bone conduction device.

Figure 14:
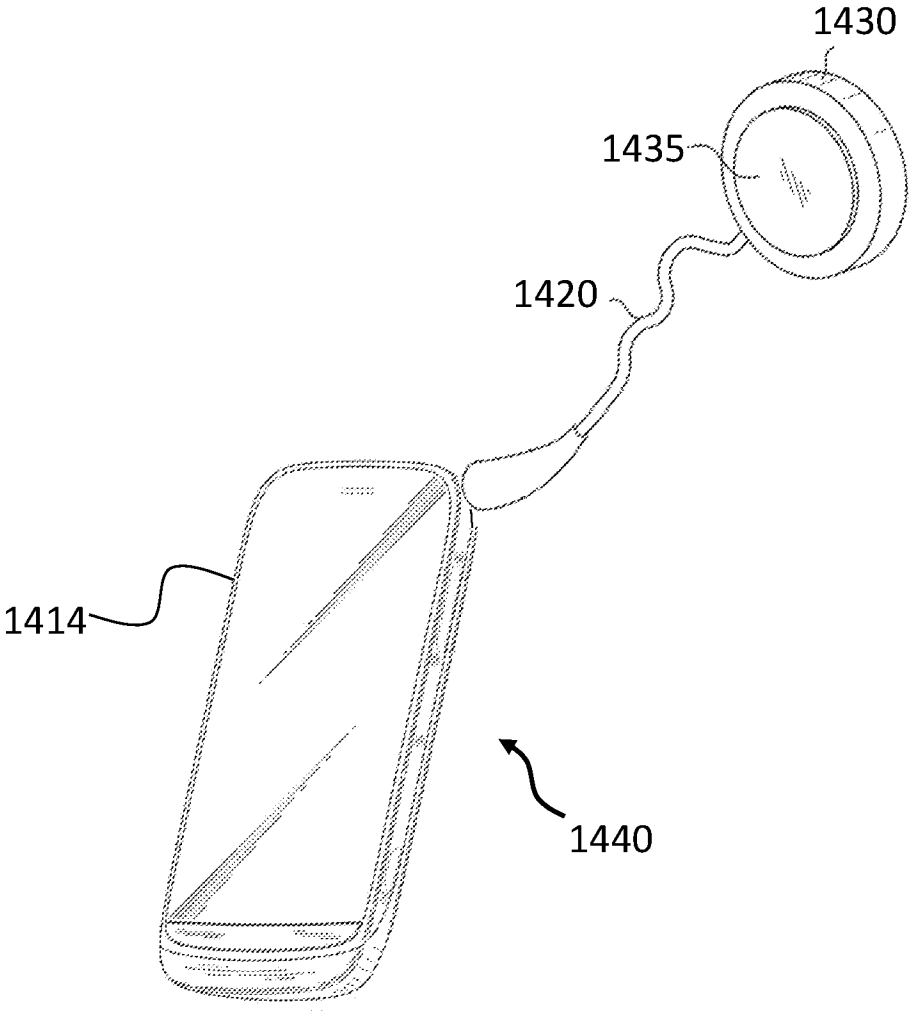
FIG. 14 depicts an exemplary embodiment of an external component usable in some embodiments.

FIG. 14 depicts an exemplary embodiment of an external component 1440 which can correspond to the external component 440 of FIG. 3B. FIG. 14 depicts a so-called smart phone or other portable handheld electronic device 1414. The smartphone 1414 is in signal communication with a headpiece 1430 via cable 1420. Headpiece 1430 is held against the skin of the recipient via a magnet 1435, which, in an exemplary embodiment, interacts with magnet 558, by way of example only and not by way of limitation, when implantable component 550 is implanted via the skin of the recipient. In an exemplary embodiment, headpiece 1430 includes a first inductance coil, corresponding to the functional inductance coil 1242 of FIG. 12. In this exemplary embodiment, the smart phone 1414 is in signal communication with this inductance coil 1430. In an exemplary embodiment, the inductance coil of the headpiece 1430 is energized by an output signal outputted by the smart phone 1414. The energized inductance coil creates an inductance field, which inductance field induces a current in the implanted inductance coil 1266. This induced current causes the piezo component 1251 to expand and/or contract, and thus causes the implantable component to generate vibrations, thereby evoking a hearing percept.

Is briefly noted that while element 1414 is a smart phone, in an alternate embodiment, that device can be an MP3 player, or some other type of body worn device that outputs a voltage based on audio/sound content, etc.

It is noted that in an exemplary embodiment, there is an external component corresponding to that of FIG. 14, and an implantable component corresponding to that of FIG. 5. In an exemplary embodiment, the smartphone is configured to capture ambient sound utilizing a microphone therein, and output and audio signal to the headpiece 1432 energized inductance coil therein so as to establish the transcutaneous link, and thus energize the implanted coil to evoke a hearing percept utilizing the implanted component.

With respect to the embodiments of FIG. 12, it can be understood that the headpiece coil 1242 is part of a first LC resonant tank circuit, and the implanted coil 1266 is part of a second LC resonant tank circuit. Both of these resonant tank circuits establish the transcutaneous link 1203 between the two. It is noted that in an exemplary embodiment, the circuit of the external component 1240 is not a tank circuit/LC resonant circuit. In an exemplary embodiment, the external component 1240 utilizes an inductance coil that is "energized" according to the arrangements that are utilized in traditional transcutaneous devices (e.g., such as the arrangement utilized on cochlear implants and/or traditional active transcutaneous bone conduction devices and or implanted middle ear implants etc.).

In an exemplary embodiment, the coil 1242 is a passive headpiece coil, and the implanted coil is a passive implanted coil. In at least some exemplary embodiments, the headpiece coil 1242 can be connected to a class D audio amplifier which, in some exemplary embodiments, includes energy recovery, PWM, or S/D, and thus in an exemplary embodiment, there is an external component of a prosthesis that includes these components. In an exemplary embodiment, the amplifier is utilized to amplify the incoming audio signals from the voltage source 1226 a level that can drive the coil 1242 so as to achieve a current that will establish a viable inductance link/in inductance link that has utility with respect to the practicing teachings detailed herein and/or variations thereof. Accordingly, in an exemplary embodiment, the circuit 1292 would include active electronic devices. Thus, in an exemplary embodiment, only circuit 1291 is devoid of such active devices. In an exemplary embodiment, the passive headpiece coil 1242 can be connected to any audio source having a headphone line output (e.g., such as the smart phone 1440 of FIG. 14). In the exemplary embodiments detailed herein, the resident frequencies of the tank circuits of the external component and the implantable component fall within the audio spectrum. In an exemplary embodiment, the resident frequencies of the external tank circuit and/or of the internal tank circuit are no more than 1 kHz, 1.5 kHz, 2 kHz, 2.5 kHz, 3.0 kHz, 3.5 kHz, 4.0 kHz, 4.5 kHz, 5 kHz, 5.5 kHz, 6 kHz, 6.5 kHz, 7 kHz, 7.5 kHz, 8.0 kHz, 9 kHz, 10 kHz, 11 kHz, 12 kHz, 13 kHz, 14 kHz, 15 kHz, 16 kHz, 17 kHz, 18 kHz, 19 kHz, or 20 kHz.

As will be understood from the diagrams of FIGS. 12 and 13, the tank circuits are series resonant tank circuits.

Figure 15:
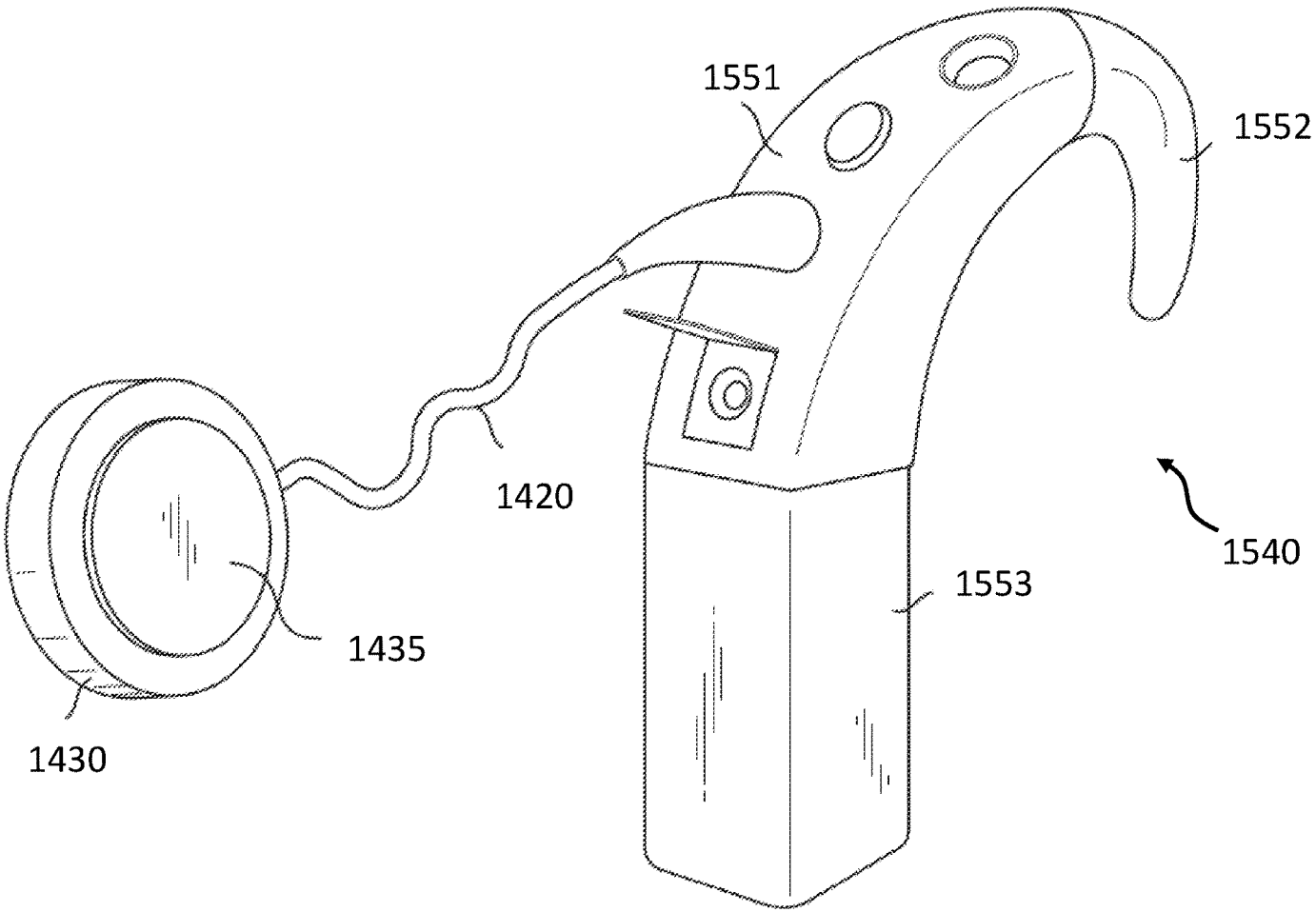
FIG. 15 depicts another exemplary embodiment of an external component usable in some embodiments.

FIG. 15 depicts an alternate embodiment of an external component, external component 1540, which corresponds to an external component usable as the external component of FIG. 3B. In this embodiment, there is a behind-the-ear device (BTE) that includes a behind the ear spine 1551 having microphone ports, and ear hook 1552, and a battery 1553. In an exemplary embodiment, the microphone captures sound, and a sound processor in the behind-the-ear device converts and amplifies that sound into an output signal which is fed to the headpiece 1430 via cable 1420. That said, in an alternate embodiment, there is no sound processor in the external component. Instead, there is only an amplifier and the like that amplifies the voltage outputted by the microphone so as to enable transcutaneous inductance communication according to the teachings detailed herein. That output signal energizes the inductance coil located in the headpiece 1430 to evoke a hearing percept according to the teachings detailed herein by energizing the implanted inductance coil. In this exemplary embodiment, the signal processor can be utilized for audio processing, which signal processor is located in the behind-the-ear device, and an S/D or PWM audio amplifier can be connected to a first resonant tank circuit of the external component 1540 so as to implement the teachings detailed herein.

Figure 16:
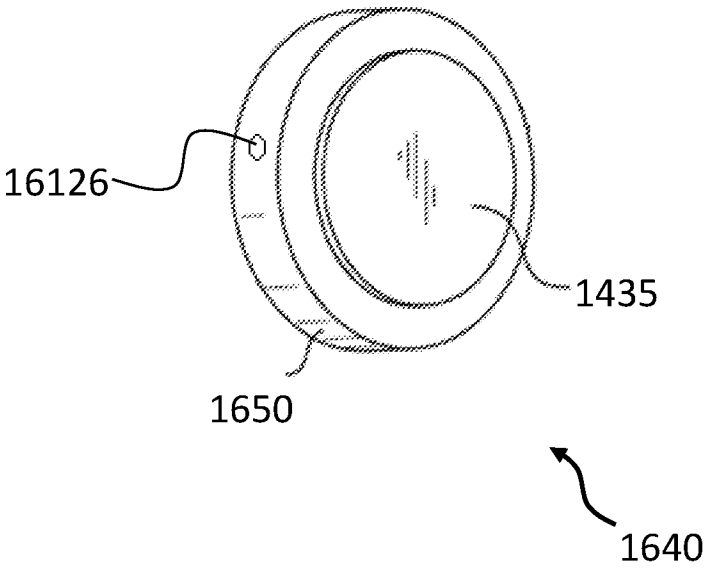
FIG. 16 depicts another exemplary embodiment of an external component usable in some embodiments.

FIG. 16 depicts an alternate embodiment of an external component, external component 1640, which corresponds to an external button shaped component usable as the external component of FIG. 3B. In this embodiment, there is a so called button sound processor 1650, which is configured to be retained against the skin of the recipient via a magnet 1435. The button sound processor 1650 includes a microphone 16126 which captures sound, and a sound processor in the button sound processor 1650 converts the sound into a signal that is after amplification supplied to an inductance coil located in the button sound processor 1650 to energize the inductance coil located therein to evoke a hearing percept according to the teachings detailed herein by energizing the implanted inductance coil. That said, in an exemplary embodiment, in an alternate embodiment of the "button sound processor" 1650, there is no sound processor per se therein. Instead, there is a sound capture apparatus (or plurality thereof) along with an audio a.m. amplifier and the like so as to amplify the output of the sound capture apparatus so as to enable inductance communication according to the teachings detailed herein. In this exemplary embodiment, the signal processor can be utilized for audio processing, which signal processor is located in the behind-the-ear device, and an S/D audio amplifier can be connected to a first resonant tank circuit of the external component 1540 so as to implement the teachings detailed herein.

It is noted that in an exemplary embodiment, the inductance coil of the headpiece can be part of a series tank circuit. In an exemplary embodiment, any low ohmeric output that can deliver sufficient current to the implantable component by way of the inductance link can be utilized. In at least some exemplary embodiments, the series tank circuit just noted would operate at 2 or 3 volts. Again, as noted above, some exemplary embodiments do not utilize a tank circuit in the external component. In at least some exemplary embodiments, a vibrating external magnet can be utilized to create the external portion of the link 1203. In an exemplary embodiment, the external component to utilize any alternating magnetic field that will generate an inductance field sufficient to energize the implantable coil 1266.

Figure 17:
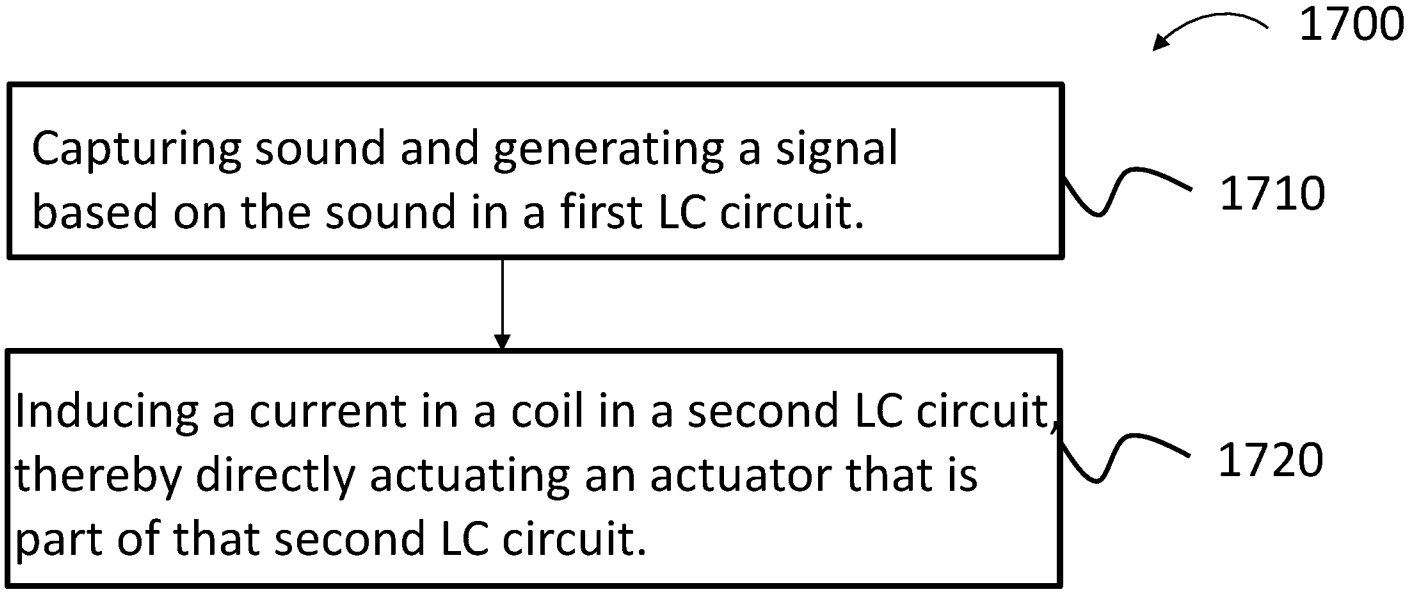
FIG. 17 depicts an exemplary flowchart according to an exemplary method.

FIG. 17 depicts a flowchart for an exemplary method 1700 according to an exemplary embodiment. Method 1700 includes method action 1710, which entails capturing sound and generating a signal based on that sound in a first LC circuit. By way of example only and not by way of limitation, this can entail capturing sound with any of the microphones disclosed herein and/or variations thereof. Based on this captured sound, a signal is generated in a first LC circuit, such as by way of example, circuit 1292. This induces current flow in coil 1242, which creates an inductance field 1203. Method 1700 further includes method action 1720, which entails inducing a current in a coil in a second LC circuit, thereby directly actuating an actuator that is part of that second LC circuit. In an exemplary embodiment, the inductance field 1203 is transcutaneously transmitted to coil 1266, which induces a current in that coil, which current actuates the actuator. In an exemplary embodiment associated with actuation of the actuator directly from the implanted coil, there is no diode envelope detector or the like between the implanted coil and the actuator (hence there is direct actuation). Indeed, in an exemplary embodiment, because the actuator is directly actuated from the energized implanted coil, there is no electronic component passive or otherwise other than conductor components between the coil and the actuator.

Is briefly noted that in an exemplary embodiment, the implantable component 450 in general, or the circuit 1291 in particular, is devoid of any diode envelope detector. This is as contrasted to the embodiment of FIG. 3A, where implantable component 451 includes an RF detector (i.e. diode envelope detector) and/or active component. In an exemplary embodiment, the diode is utilized as an envelope detector for the amplitude modulated RF signal.

In an exemplary embodiment, the actuator is a vibratory apparatus. As detailed above, in an exemplary embodiment, the actuator and the coil of the second LC circuit are encased in a titanium housing. In this exemplary method, the transcutaneous signals that are received through the titanium housing by the second LC circuit, or, more accurately, the coil of the second LC circuit, activate the vibratory apparatus to evoke a hearing percept.

It is noted that any method detailed herein also corresponds to a disclosure of a device and/or system configured to execute one or more, or all of the method actions associated therewith detailed herein. In an exemplary embodiment, this device and/or system is configured to execute one, or more, or all of the method actions in an automated fashion. That said, in an alternate embodiment, the device and/or system is configured to execute one, or more, or all of the method actions after being prompted by the recipient.

It is further noted that any device and/or system detailed herein also corresponds to a disclosure of a method of operating that device and/or using that device. Furthermore, any device and/or system detailed herein also corresponds to a disclosure of manufacturing or otherwise providing that device and/or system.

It is also noted that at least some embodiments include a combination of one or more of the teachings detailed herein with one or more of the other teachings detailed herein. In this regard, any feature of any embodiment can be combined with any other feature of any other embodiment providing that the art enable such unless otherwise specified.

In an exemplary embodiment, there is a prosthesis, comprising an implantable component including an LC circuit, wherein a piezoelectric material forms at least a part of the capacitance portion of the LC circuit. In an exemplary embodiment, there is a prosthesis as detailed above and/or below, wherein the piezoelectric material forms the entirety of the capacitance portion of the LC circuit. In an exemplary embodiment, there is a prosthesis as detailed above and/or below, wherein the piezoelectric material forms part of an actuator configured to output a force to tissue of a recipient in which the implantable component is implanted. In an exemplary embodiment, there is a prosthesis as detailed above and/or below, wherein the piezoelectric material expands and/or contracts upon the application of an electromagnetic field to the inductor of the LC circuit. In an exemplary embodiment, there is a prosthesis as detailed above and/or below, wherein the piezoelectric material expands and/or contracts due to direct application of the current induced at the inductor by the magnetic field to the piezoelectric material. In an exemplary embodiment, there is a prosthesis as detailed above and/or below, wherein the piezoelectric material expands and/or contracts at a frequency corresponding to a frequency of an electromagnetic field to which the inductor exposed. In an exemplary embodiment, there is a prosthesis as detailed above and/or below, wherein the LC circuit is entirely contained and hermetically sealed in a titanium housing without openings through the titanium housing. In an exemplary embodiment, there is a prosthesis as detailed above and/or below, wherein the prosthesis is a hearing prosthesis, and wherein the piezoelectric material is configured to generate vibrations to evoke a hearing percept.

In an exemplary embodiment, there is a prosthesis, comprising an implantable component including a transducer configured to output a mechanical force when an electrical current is applied thereto, wherein a circuit of which the transducer is apart is entirely made up of passive electronic components. In an exemplary embodiment, there is a prosthesis as detailed above and/or below, wherein the implantable component is an implantable component of an active transcutaneous bone conduction device. In an exemplary embodiment, there is a prosthesis as detailed above and/or below, wherein the transducer is a piezoelectric actuator. In an exemplary embodiment, there is a prosthesis as detailed above and/or below, wherein the implantable component includes a copper coil that is part of the circuit, the copper coil being an inductance coil of a transcutaneous link. In an exemplary embodiment, there is a prosthesis as detailed above and/or below, wherein the implantable component includes an inductance coil configured to receive electromagnetic radiation having frequencies in the audio spectrum, and the transducer is configured to vibrate at the frequencies of the electromagnetic radiation received by the inductance coil. In an exemplary embodiment, there is a prosthesis as detailed above and/or below, wherein the circuit is an LC circuit that comprises only an inductance coil and one or more components corresponding to capacitance components. In an exemplary embodiment, there is a prosthesis as detailed above and/or below, further comprising:

an external component including a first inductance coil;

a smart phone in signal communication with the first inductance coil, wherein the implantable component includes a second inductance coil, the transducer is configured to vibrate based on an inductance field subjected to the second inductance coil generated by the first inductance coil to evoke a hearing percept, and the first inductance coil is energized by a signal outputted by the smartphone to generate the inductance field.

In an exemplary embodiment, there is a prosthesis, comprising an implantable component including a vibratory apparatus and an inductance coil, wherein the vibratory apparatus and the inductance coil are encased in a titanium housing, and the implantable component is configured such that a transcutaneous signal received by the inductance coil through the titanium housing activates the vibratory apparatus to evoke a hearing percept. In an exemplary embodiment, there is a prosthesis as detailed above and/or below, wherein the implantable component is devoid of any integrated circuits. In an exemplary embodiment, there is a prosthesis as detailed above and/or below, wherein the housing entirely and completely encompasses the coil and the vibratory apparatus, thus being devoid of any feedthrough passages. In an exemplary embodiment, there is a prosthesis as detailed above and/or below, wherein the implantable component is entirely devoid of precious metals. In an exemplary embodiment, there is a prosthesis as detailed above and/or below, further comprising an external component including a second electrical coil, wherein the hearing prosthesis is configured to establish an electromagnetic link entirely at audio frequencies to operate the vibratory apparatus to evoke a hearing prosthesis.

In an exemplary embodiment, there is a hearing prosthesis, comprising an external component, and an implantable component, wherein the hearing prosthesis is configured to establish a transcutaneous electromagnetic link between the implantable component and the external component at very low frequencies and or lower, and the implantable component includes an actuator that is driven by the link to evoke a hearing percept. In an exemplary embodiment, there is a prosthesis as detailed above and/or below, wherein the actuator is configured to vibrate when the transcutaneous link is present at the very low frequencies and lower. In an exemplary embodiment, there is a prosthesis as detailed above and/or below, wherein the actuator has at least one resonant frequency at a value less than 4000 Hz. In an exemplary embodiment, there is a prosthesis as detailed above and/or below, wherein the link is established in part by a copper coil in the internal component. In an exemplary embodiment, there is a prosthesis as detailed above and/or below, wherein the actuator is powered entirely and solely by the electromagnetic link. In an exemplary embodiment, there is a prosthesis as detailed above and/or below, wherein the implantable component includes a single housing encompassing the actuator and a coil that forms part of the link. In an exemplary embodiment, there is a prosthesis as detailed above and/or below, wherein the implantable component is impervious to EMI at frequencies above 50 kHz.

While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. A hearing prosthesis, comprising:

an implantable passive resonant component including a vibratory electrical capacitive apparatus and an inductance coil, wherein the vibratory apparatus and the inductance coil are encased in a titanium housing, and the implantable component is configured such that a transcutaneous signal received by the inductance coil through the titanium housing activates the vibratory apparatus to evoke a hearing percept, wherein the implantable passive resonant component is an implantable component of an active transcutaneous bone conduction device, the housing is configured to be implanted in a head of a person behind a location of an outer ear of the head, between skin of the person and an outer surface of a skull of the person, and secured at the location, and the vibratory electrical capacitive apparatus is directly powered by the inductance coil when the inductance coil is inductively energized.

2. The hearing prosthesis of claim 1, wherein:

the implantable component is devoid of any integrated circuits.

3. The hearing prosthesis of claim 1, wherein:

the housing entirely and completely encompasses the coil and the vibratory apparatus, thus being devoid of any feedthrough passages.

4. The hearing prosthesis of claim 1, wherein:

the vibratory apparatus is configured to vibrate when the inductance coil is exposed to a transcutaneous magnetic link and/or electromagnetic link of very low frequencies and lower.

5. The hearing prosthesis of claim 4, wherein:

the vibratory apparatus is powered entirely and solely by the magnetic and/or electromagnetic link.

6. The hearing prosthesis of claim 1, wherein:

the housing hermetically seals the inductance coil therein, and the inductance coil is made up of copper.

7. The hearing prosthesis of claim 1, wherein:

the inductance coil is a copper coil having at least 100 turns.

8. The hearing prosthesis of claim 1, wherein:

the implantable passive resonant component establishes a circuit that is tuned to a frequency in the audio spectrum.

9. The hearing prosthesis of claim 1, wherein:

the hearing prosthesis is configured to establish a transcutaneous link at frequencies below 300 kHz that drives the vibratory electrical capacitive apparatus, wherein the vibratory electrical capacitive apparatus is the only power storage device in the implantable portion of the hearing prosthesis.

10. The hearing prosthesis of claim 1, wherein:

the vibratory electrical capacitive apparatus forms the entirety of the capacitance portion of the implantable passive resonant component.

11. The hearing prosthesis of claim 1, further comprising:

an external component including a second inductance coil, wherein the external component includes a smart phone in signal communication with the second inductance coil.

12. The hearing prosthesis of claim 1, wherein:

the housing has a width that is greater than its height and is a biocompatible housing without openings through structure of the biocompatible housing.

13. The hearing prosthesis of claim 1, wherein:

the housing consists of two titanium bodies welded together to form a hermetically sealed housing.

14. The hearing prosthesis of claim 1, wherein:

the implantable passive resonant component includes an LC circuit of which the vibratory electrical capacitive apparatus and the inductance coil are a part, wherein the vibratory electrical capacitive apparatus is a piezoelectric material, the piezoelectric material expands and/or contracts upon the application of a variable magnetic field to the inductance coil of the LC circuit, and the hearing prosthesis is configured so that energizement of the piezoelectric material via power transmitted over the link imparts energy into bone of a recipient in which the passive resonant component is implanted to evoke a hearing percept, the recipient being the person.

15. The hearing prosthesis of claim 1, wherein:

the inductance coil is part of an assembly that establishes a ferromagnetic-core inductor.

16. The hearing prosthesis of claim 1, wherein:

the vibratory apparatus is a piezoelectric bender supported within the housing only at a mid-location of the piezoelectric bender, wherein distinct respective counterweights are attached to the piezoelectric bender at a first end and a second end opposite the first end of the piezoelectric bender, and the piezoelectric bender and the inductance coil are part of the same circuit and wherein the hearing prosthesis includes a permanent disk magnet attached to the housing, the inductance coil extending about a longitudinal axis of the disk magnet in a circular fashion, the permanent magnet configured to magnetically retain an external component that includes an external inductance coil and a permanent magnet against skin of a recipient of the hearing prosthesis so that the external component can inductively communicate with the inductance coil in the housing, the recipient being the person.

17. The hearing prosthesis of claim 1, wherein:

the vibratory electrical capacitive apparatus is a piezoelectric bender.

18. A hearing prosthesis, comprising:

an implantable passive resonant component including a vibratory electrical capacitive apparatus and an inductance coil, wherein the vibratory apparatus and the inductance coil are encased in a titanium housing, and the implantable component is configured such that a transcutaneous signal received by the inductance coil through the titanium housing activates the vibratory apparatus to evoke a hearing percept, wherein the implantable passive resonant component is an implantable component of an active transcutaneous bone conduction device, the housing is configured to be implanted in a head of a person behind a location of an outer ear of the head, between skin of the person and an outer surface of a skull of the person, and secured at the location, and the implantable passive resonant component comprises a circuit consisting essentially of the vibratory electrical capacitive apparatus, the inductance coil and means for conducting electricity between the coil and the vibratory apparatus.

19. The hearing prosthesis of claim 18, further comprising:

an external component including a second inductance coil, wherein the hearing prosthesis is configured to establish an electromagnetic link entirely at audio frequencies to operate the vibratory apparatus to evoke a hearing percept.

20. The hearing prosthesis of claim 19, wherein:

the implantable passive resonant component establishes a circuit that has an electrical self-resonant frequency of below 20 kHz.

21. The hearing prosthesis of claim 19, wherein:

the hearing prosthesis is configured such that the link drives the vibratory electrical capacitive apparatus at the frequencies of the electromagnetic link.

22. The hearing prosthesis of claim 19, wherein:

the prosthesis is configured so that the housing is securable to the skull of the person by a threaded bone fixture lying on a longitudinal axis of the housing at a bottom of the housing that corresponds to a skull facing side of the housing, the bone fixture being located at the center of the housing when viewed looking down the longitudinal axis.

23. The hearing prosthesis of claim 19, wherein:

the external component includes a headpiece and a magnet, the second inductance coil and the magnet being located in the headpiece, the headpiece being configured to be located in its entirety away from an ear system of a recipient of the hearing prosthesis, the recipient being the person, the headpiece being configured to be held against the head of the recipient by the magnet.

24. The hearing prosthesis of claim 23, wherein:

the magnet is a first magnet;

the implantable passive resonant component includes a second magnet;

the second inductance coil of the external component is configured to be held against the head of the recipient by magnetic interaction between the first magnet and the second magnet.

25. The hearing prosthesis of claim 18, wherein:

the inductance coil is a copper coil having at least 1000 turns.

26. The hearing prosthesis of claim 18, wherein:

the hearing prosthesis is configured to establish a transcutaneous link at frequencies that have values below 300 kHz that drives the vibratory electrical capacitive apparatus, wherein the vibratory electrical capacitive apparatus is the only capacitive device in the implantable portion of the hearing prosthesis.

27. The hearing prosthesis of claim 18, wherein:

the vibratory electrical capacitive apparatus expands and/or contracts due to direct application of current induced at the inductance coil by an alternating magnetic field originating outside the housing.

28. The hearing prosthesis of claim 18, wherein:

the vibratory electrical capacitive apparatus is a piezoelectric component that supports a counterweight inside the housing, the hearing prosthesis being configured to move the counterweight within the housing in an oscillating manner via the piezoelectric component so as to create vibrations that are then transferred from the housing to bone of a recipient of the hearing prosthesis, which vibrations travel along the bone to the inner ear of the recipient, to evoke a hearing percept via bone conduction, the recipient being the person.

29. The hearing prosthesis of claim 18, wherein:

the housing entirely and completely encompasses the coil and the vibratory apparatus, thus being devoid of any feedthrough passages.

30. The hearing prosthesis of claim 18, wherein:

the housing consists of two titanium bodies welded together to form a hermetically sealed housing.

31. The hearing prosthesis of claim 18, wherein:

the vibratory electrical capacitive apparatus is a piezoelectric bender.

32. A hearing prosthesis, comprising:

an implantable passive resonant component including a vibratory electrical capacitive apparatus and an inductance coil, wherein the vibratory apparatus and the inductance coil are encased in a titanium housing, and the implantable component is configured such that a transcutaneous signal received by the inductance coil through the titanium housing activates the vibratory apparatus to evoke a hearing percept, wherein the implantable passive resonant component is an implantable component of an active transcutaneous bone conduction device, the housing is configured to be implanted in a head of a person behind a location of an outer ear of the head, between skin of the person and an outer surface of a skull of the person, and secured at the location, and all electronic components in the housing consist essentially of the inductance coil and the vibratory apparatus.

33. The hearing prosthesis of claim 32, wherein:

the inductance coil is a copper coil.

34. The hearing prosthesis of claim 32, further comprising:

an external component including a second inductance coil, wherein the hearing prosthesis is configured to establish an electromagnetic link entirely at frequencies below 300 kHz to operate the vibratory apparatus to evoke a hearing percept, wherein all batteries of the hearing prosthesis are located in the external component.

35. The hearing prosthesis of claim 32, wherein:

the vibratory electrical capacitive apparatus expands and/or contracts at a frequency and amplitude corresponding to a frequency and amplitude of a magnetic field to which the inductance coil is exposed when such magnetic field induces current in the inductance coil that powers the electrical capacitive apparatus to expand and/or contract.

36. The hearing prosthesis of claim 32, wherein:

the vibratory electrical capacitive apparatus is a piezoelectric bender.

37. The hearing prosthesis of claim 32, further comprising:

an external component including a second inductance coil, wherein the external component includes a smart phone in signal communication with the external component.

38. The hearing prosthesis of claim 32, wherein:

the housing entirely and completely encompasses the coil and the vibratory apparatus, thus being devoid of any feedthrough passages.

39. The hearing prosthesis of claim 32, wherein:

the housing consists of two titanium bodies welded together to form a hermetically sealed housing.

* * * * *